US007309299B2

(12) United States Patent
Pezzato et al.

(10) Patent No.: US 7,309,299 B2
(45) Date of Patent: Dec. 18, 2007

(54) SPORTS RACQUET WITH FRAME OPENINGS

(76) Inventors: Mauro Pezzato, Via K2, 11, Treviso (IT) I-31100; Michele Pozzobon, Via Flume, 10, Fossalonga Di Vedelago (IT) I-31050

( * ) Notice: Subject to any disclaimer, the term of this patent is extended or adjusted under 35 U.S.C. 154(b) by 15 days.

(21) Appl. No.: 10/547,067

(22) PCT Filed: Feb. 27, 2004

(86) PCT No.: PCT/IB2004/000607

§ 371 (c)(1),
(2), (4) Date: Dec. 5, 2005

(87) PCT Pub. No.: WO2004/075996

PCT Pub. Date: Sep. 10, 2004

(65) Prior Publication Data

US 2006/0172828 A1 Aug. 3, 2006

(30) Foreign Application Priority Data

Feb. 28, 2003 (IT) ..... BG2003A0016

(51) Int. Cl.
*A63B 49/02* (2006.01)

(52) U.S. Cl. ..... 473/540; 473/524; 473/543; 473/546

(58) Field of Classification Search ..... 473/524, 473/539, 540, 543, 546
See application file for complete search history.

(56) References Cited

U.S. PATENT DOCUMENTS 1,611,232 A * 12/1926 Reach ..... 473/539
2,230,177 A * 1/1941 Caines ..... 473/540
3,901,507 A * 8/1975 Santini-Ormieres et al. ..... 473/540
3,930,920 A 1/1976 Kicherer
4,681,319 A 7/1987 Zilinskas (Continued)

FOREIGN PATENT DOCUMENTS

DE 4415509 11/1995

(Continued)

OTHER PUBLICATIONS

European Patent Office, Extended European Search report, Nov. 22, 2006.

*Primary Examiner*—Raleigh W. Chiu
(74) *Attorney, Agent, or Firm*—Fox Rothschild, LLP; Dennis Carleton

(57) ABSTRACT

A sports racquet has a plurality of opposed string holes for anchoring the ends of the strings, at least one pair of contiguous string holes are replaced with an enlarged string hole having opposed bearing surfaces for securing the ends of a pair of contiguous string segments. Preferably, a plurality of contiguous enlarged string holes are employed along the sides, tip, and heel or throat bridge of the racquet, in order to reduce the weight of the racquet head. Also, preferably, the enlarged string holes are defined by a pair of opposed interior walls of the frame extending between the frame's inner and outer surfaces, thereby forming a truss-like internal structure for stiffening the frame. Moreover, the frame preferably has interior wall portions that extend between the string holes. Such wall portions lie in the string bed plane and underlie the string portions on the exterior of the frame.

12 Claims, 23 Drawing Sheets

U.S. PATENT DOCUMENTS

| | | | | | |
|---|---|---|---|---|---|
| 4,930,778 | A | * | 6/1990 | Mizuno | 473/540 |
| 5,014,987 | A | * | 5/1991 | Soong | 473/537 |
| RE34,420 | E | * | 10/1993 | Darling | 473/537 |
| 5,833,560 | A | * | 11/1998 | Davis et al. | 473/537 |
| 5,993,337 | A | | 11/1999 | Janes et al. | |
| 6,050,909 | A | * | 4/2000 | Severa et al. | 473/524 |
| 6,319,160 | B1 | * | 11/2001 | Hsu | 473/540 |
| 6,527,656 | B1 | * | 3/2003 | Cheng et al. | 473/540 |
| 6,800,239 | B2 | | 10/2004 | Davis | |
| 6,811,502 | B1 | * | 11/2004 | Janes et al. | 473/546 |
| 2005/0153798 | A1 | | 7/2005 | Rigoli | |
| 2005/0164814 | A1 | | 7/2005 | Tucker et al. | |
| 2006/0172828 | A1 | * | 8/2006 | Pezzato et al. | 473/527 |

FOREIGN PATENT DOCUMENTS

| | | | | |
|---|---|---|---|---|
| EP | 1151762 | A3 | | 1/2003 |
| JP | H6-319833 | | | 11/1994 |
| JP | P2005-177244 | A | * | 7/2005 |
| WO | WO 94/26361 | | | 11/1994 |
| WO | WO 01/26752 | | | 4/2004 |

* cited by examiner

SPORTS RACQUET WITH FRAME OPENINGS

CROSS-REFERENCE TO RELATED APPLICATIONS

This application claims priority to Italian patent application number BG2003A000016 filed Feb. 28, 2003, and to PCT International Application Serial No. PCT/IB04/000607, filed Feb. 27, 2004, both of which are incorporated herein by reference.

BACKGROUND OF THE INVENTION

The present invention relates to sports racquets, for example tennis, squash, badminton, and racquetball racquets. Such racquets have a head portion containing an interwoven string bed, a handle, and a shaft portion connecting the head portion to the handle.

High performance sports racquets normally have a frame made with a composite material such as carbon fibers embedded in an epoxy resin (known as a "graphite" frame). Other materials, such as tungsten or titanium, may also be included in the frame, for example at select locations.

Advances in materials technology permit racquet frames to be made lighter and stiffer, and also allow the racquet to be designed with characteristics geared towards certain types of players. For example, it is well known that the addition of weights at various portions of the racquet head can affect the playing characteristics of the racquet. Adding weight at locations spaced from the longitudinal axis will increase the polar moment of inertia, making the racquet more stable in the case of off-center hits. Adding weights to the head portion also will increase the mass moment of inertia (swing weight), making the racquet more head heavy. Depending on where the weights are located, such weights may advance the sweet spot (center of percussion) and increase the moment of inertia about the center of gravity.

It is also well known that the frame design can be varied to affect the stiffness of the racquet. For example, increasing the cross-sectional frame height tends to make the racquet stiffer in bending. Making the frame more box-like increases torsional stiffness. The bending as well as torsional stiffness of the frame are also affected by the orientation of the carbon fibers in the composite material. Thus, if greater bending stiffness is desired, the layers of composite material forming the frame can be oriented so that more of the carbon fibers extend axially. If greater torsional stiffness is desired, the layers of composite material that make up the frame are oriented so that more of the carbon fibers are oriented at an angle relative to the longitudinal axis.

While it is known that the properties of a sports racquet can be changed through these various techniques, the design of a sports racquet is complex due to the way that forces are transmitted through the racquet. For example, when a ball strikes the string bed, the strings partially transmit the energy of the ball impact to the head portion of the frame through torsion. Such force is transmitted to the handle through a combination of torsion and bending, depending upon the particular the location on the frame.

Racquet design under the current state of technology is based on diverse optimization criteria with the goal of principally obtaining frames which are both rigid and lightweight. Such features are important in that they provide greater control of the sports racquet and a reduction of the force that the player's arm must apply.

The known methods for reducing the weight of the racquet are predominantly the use of improved materials and varying the frame shape.

BRIEF SUMMARY OF THE INVENTION

The present invention is a sports racquet for tennis, squash, badminton, racquetball, and similar games, that has improved torsional stiffness and lighter weight. The invention is directed to the observation that, in sports racquets, there are certain areas in the head portion of the racquet where material is not needed either to counteract the pulling force of the strings or to maintain the mechanical integrity of the frame. Forming racquets with material in these areas unnecessarily increases the overall weight of the frame and limits the potential design capabilities for improving the performance of the frame. Thus, in accordance with the present invention, material is eliminated in areas of the frame where such material is not needed for mechanical strength or to support the stringing.

The present invention is a sports racquet which includes a head portion and a handle, and preferably a shaft portion connecting the head portion and the handle. The head portion includes a plurality of string holes for anchoring the ends of a plurality of string segments to form a string bed. A first plurality of string segments extends in a first direction, and a second plurality of string segments extends in a direction at least generally perpendicular to the first string segments and are interwoven with the first string segments to form a string bed.

In accordance with the invention, the head portion contains at least one string hole which receives the ends of two contiguous string segments of said first plurality of string segments. Such string hole contains opposite ends. One end secures and guides one of the two string segments. The opposite end secures and guides the next, contiguous string segment. As used in this patent application, the term "enlarged string hole" means a string hole as described in this paragraph.

Preferably, the head portion includes a plurality of enlarged string holes, each receiving the ends of a pair of contiguous string segments of said first plurality of string segments. Further, preferably the head portion includes a plurality of said enlarged string holes on opposite sides of said frame, the enlarged string holes on opposite sides of the frame being staggered relative to one another. The holes are sized and positioned so that the ends of the strings are anchored at their desired positions in the string bed.

In one embodiment, the first plurality of string segments constitute cross strings and the second plurality of strings constitute main strings. In addition to having enlarged string holes receiving the ends of some cross strings, preferably the head portion has one or more enlarged string holes in the tip region. In another preferred embodiment, the head portion includes a throat bridge containing at least one enlarged string hole.

The string holes can have any suitable shape, such as elliptical, circular, polygonal, rounded, convex, concave, or irregular. In this manner, a sports racquet according to the invention comprises a structure in which the frame is comprised only of the parts necessary to the stringing or needed for mechanical strength. The use of enlarged string holes allows the overall weight of the racquet to be reduced and makes stringing easier.

In a preferred embodiment, the frame is formed with internal wall portions that provide mechanical strength to the regions of the head bearing string loads, and provide improved stiffness in regions of the head which do not bear string loads, by forming a truss-like internal supporting structure.

The present invention is relatively simple and economical to manufacture. Also, in the preferred embodiment the string holes are not drilled after molding, as in conventional racquets, but are molded into the frame. Thus, in contrast to conventional racquets where carbon fibers are cut when the holes are formed, thereby weakening the frame, in the present invention frame strength is maintained.

The present invention simplifies the stringing of the racquet by making it easier to thread the strings through the frame. If desired, opposite ends of the enlarged string holes may include guides to further assist in seating the strings in their proper location as they enter and leave the string holes.

In one embodiment, the racquet is formed by molding two tubes of prepreg material in accordance with a process as generally described in U.S. Published Patent Application No. US 2003/0162613. In the process described in the aforementioned publication, the two tubes form an upper and lower frame half, respectively, of the frame, String holes of conventional size are formed between the common wall of two tubes by providing a plurality of metal pins between the facing walls of the upper and lower tubes during the molding process. The pins are then removed after the frame has been molded, leaving molded string holes.

In the present invention, such process is modified such that, at each location where an enlarged string hole is desired, a molding element, in the shape of the enlarged string hole, replaces a pair of adjacent pins. As molded, in the areas of the enlarged string holes, the perimeter of the two tubes, at the enlarged string holes, is smaller than the perimeter in the case of conventionally sized holes, so that, given the same material and density in both cases, less material is needed to form the frame and the weight can be reduced.

Alternatively, the enlarged string holes can be formed in a frame molded in a conventional fashion, in which the frame is formed of a single tube and the string holes are drilled after the frame has been molded. In such embodiment, preferably a plastic grommet (which may be part of a grommet strip having a plurality of grommets) having a size and shape matching the enlarged hole is used.

Because the racquet has enlarged string holes, it is possible to insert elements in addition to the strings into the holes at various locations on the frame. These elements can be designed to change the mass and its distribution on the racquet, modify the balance of the racquet, or change the swing weight, sweet spot, or polar moment of inertia. This allows various characteristics of the racquet to be modified, such as the weight and balance, bending stiffness, or torsional stiffness. Damping material can be inserted into the enlarged string holes to damp string and/or frame vibrations. Alternately, a vibration damping grommet strip, having a plurality of grommets, each grommet having a pair of holes for receiving a pair of string holes, can be sandwiched between the frame and an outer guide strip to cushion ball impact and damp string vibrations.

It is also possible to employ enlarged string holes in the corners of the head, where both main strings and cross strings engage the frame. For example, an enlarged string hole can receive a pair of cross string ends and a main string end, or a pair of main string ends and a cross string end, or a pair of both main and cross string ends. If desired, the enlarge string hole can be shaped to secure main and cross string ends in separated locations, for ease of stringing.

Other features and advantages of the invention will become apparent from the following description of preferred embodiments, taken in conjunction with the drawings.

DETAILED DESCRIPTION OF THE INVENTION

Figure 1:
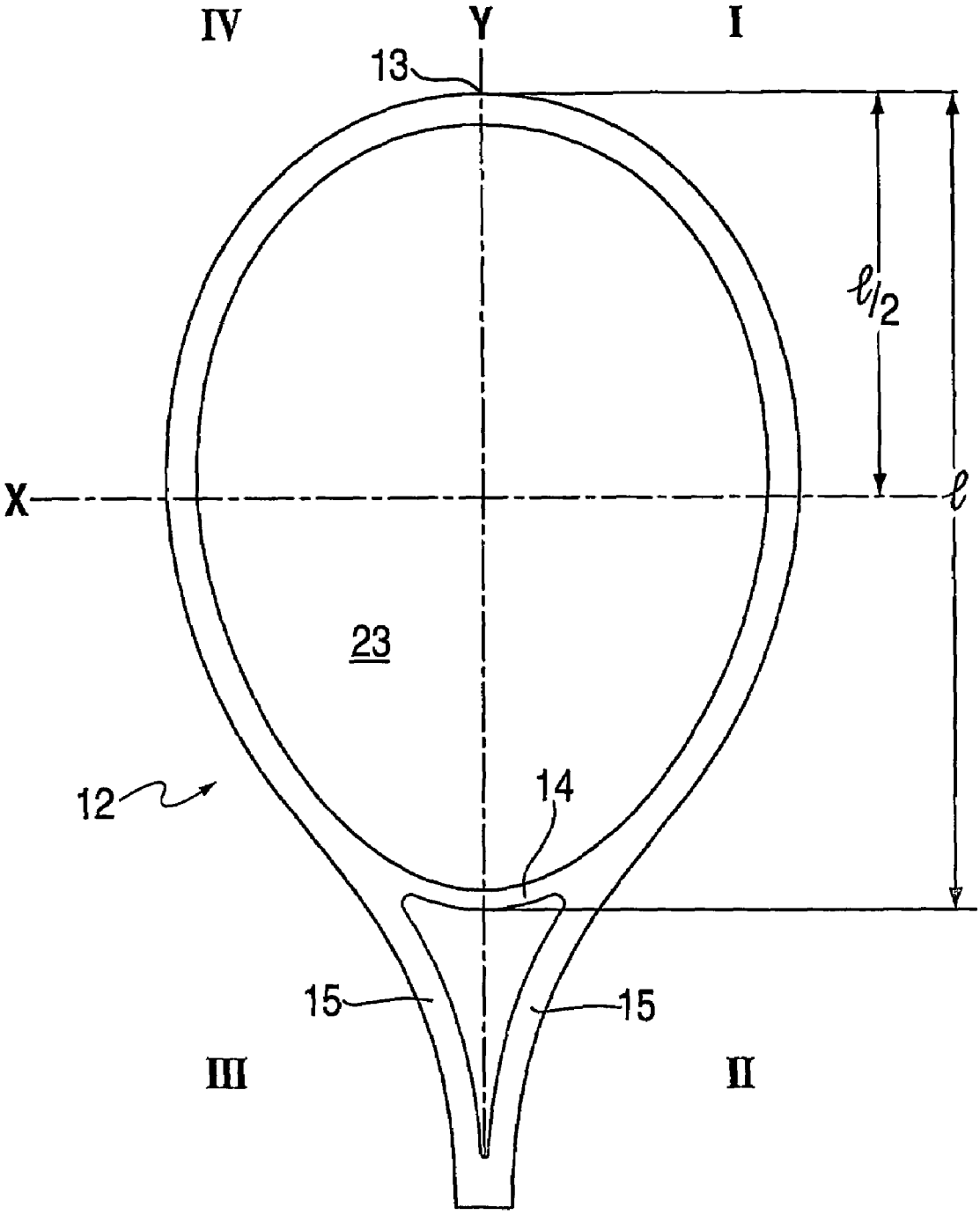
FIG. 1 is a plan view of a portion of a tennis racquet frame.

Referring to FIG. 1, which illustrates a portion of a tennis racquet frame, such frame includes a head portion 12, whose inwardly facing surface defines an area 23 in which the plane of the string bed lies. For purposes of the present invention, the plane of the string bed is defined as the central plane of the volume of space occupied by the interwoven string bed and parallel to the longitudinal and transverse axes of the head portion 12 of the racquet. As shown in FIG. 1, the head portion includes a throat bridge 14 which encloses the lower portion of the stringing area 23. The head portion is coupled to a handle portion 17 (see FIG. 2) of the frame by a pair of converging shaft members 15.

For purposes of the present invention, and with reference to the view shown in FIG. 1, the longitudinal axis Y of the head portion 12 is defined as the axis of longitudinal symmetry of the racquet. The transverse axis X of the head portion 12 is defined as the axis lying in the plane of the string bed and perpendicular to the longitudinal axis Y at a point of the head portion positioned at a distance l/2 from the tip 13 of the head portion 12, "l" being the maximum longitudinal dimension of the head portion 12 of the frame. The longitudinal axis Y and the transverse axis X define a four quadrant system, wherein quadrant I is disposed at the upper right vertex, quadrant II is disposed at the lower right vertex, quadrant III is disposed at the lower left vertex, and quadrant IV is disposed at the upper left vertex.

Figure 2:
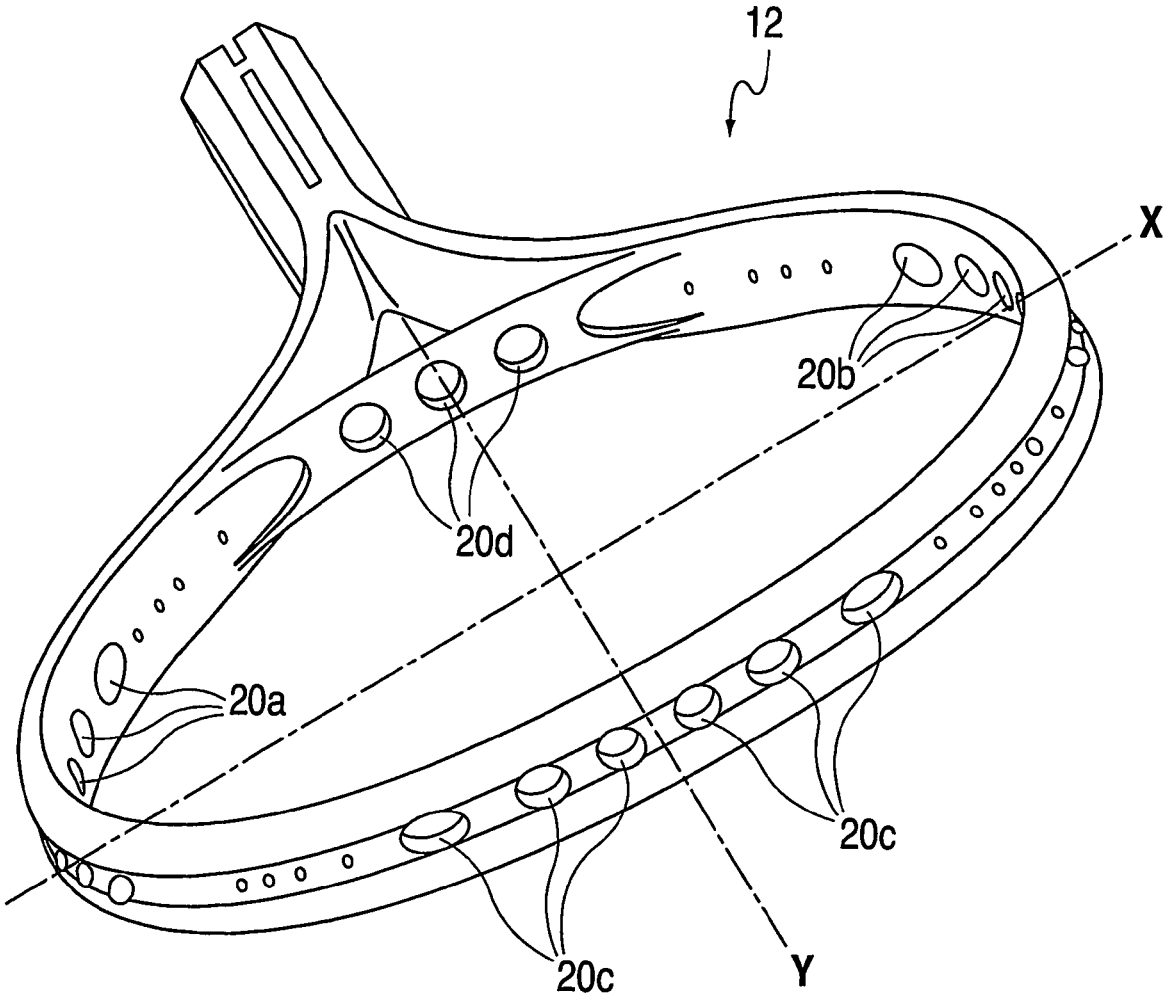
FIG. 2 is a perspective view of the tennis racquet frame of FIG. 1.

As shown in FIG. 2, the head portion 12 of the frame includes a plurality of enlarged string holes 20*a-d*. Each of these enlarged string holes 20 provides for the passage of two contiguous main strings or two contiguous cross strings and has a dimension, measured as the intersection of the hole itself with the plane of the strings, equivalent to the distance between two contiguous string segments.

The oversized dimensions of the enlarged string holes of FIG. 2 have the potential to reduce the manufacturing costs associated with the operations of flaring, cleaning, and accessing the holes compared to conventional string holes.

According to the invention, the disposition, number, and shape of the enlarged string holes 20*a-d* can vary, for example, as a function of the design of the string bed, or in order to create a particular frame design. In the example shown in FIG. 2, the head portion 12 contains four sets of enlarged string holes 20*a-d* along with a number of conventional string holes 21.

In the example shown in FIG. 2, a first plurality of enlarged string holes 20*a* are provided along one side of the head portion 12 spanning quadrants I and II. A second plurality of enlarged string holes 20*b* are provided along the opposite side of the head portion 12, spanning quadrants III and IV. The enlarged string holes 20*a* on one side of the racquet head 12 are staggered with respect to the enlarged string holes 20*b* on the opposite side of the racquet head 12. In other words, a cross string segment which exits from the lower end of one enlarged string hole 20*a* enters the upper end of an enlarged string hole 20*b* on the opposite side of the racquet (or a conventional string hole 21).

The embodiment of FIG. 2 also includes a third plurality of enlarged string holes 20*c* in the tip region, spanning the quadrants I and IV, and a fourth plurality of enlarged string holes 20*d* in the throat bridge 14, spanning the quadrants II and III. As in the case of the opposed holes 20*a* and 20*b*, the enlarged string holes 20*c* are staggered with respect to the opposed enlarged string holes 20*d*. Thus, as shown in FIG. 2, the central enlarged string hole 20*d* in the throat bridge is centered on the longitudinal axis Y, whereas the central enlarged string holes 20*c* at the racquet tip are centered to either side of the axis Y. The number and location of the enlarged string holes 20*a-d* shown in FIG. 2 is merely for illustration, and other combinations of enlarged and conventional string holes may be used. Also, it is possible to employ only enlarged string holes.

The enlarged string holes can also be used as seats for the insertion of plastic parts and/or vibration damping elements and/or weights in order to modify the mass distribution of the frame, for example, to change the balance or playing characteristics of the racquet. Enlarged openings may also be formed in portions of the frame other than the head portion, either to reduce weight or house other parts.

The invention includes alternatives to the embodiment shown in FIG. 2, characterized by an aspect substantially asymmetrical relative to FIG. 2. For example, a first layout provides a plurality of enlarged string holes 20 on a portion of the frame defined by two adjacent quadrants, e.g., quadrants I and II, or quadrant I and IV, while another layout of enlarged string holes is provided in a zone of the frame contained in a single quadrant. Thus, according to the invention, enlarged string holes can be provided in any location of the frame compatible with the characteristics of strength and rigidity required for the function of the racquet.

Figure 3:
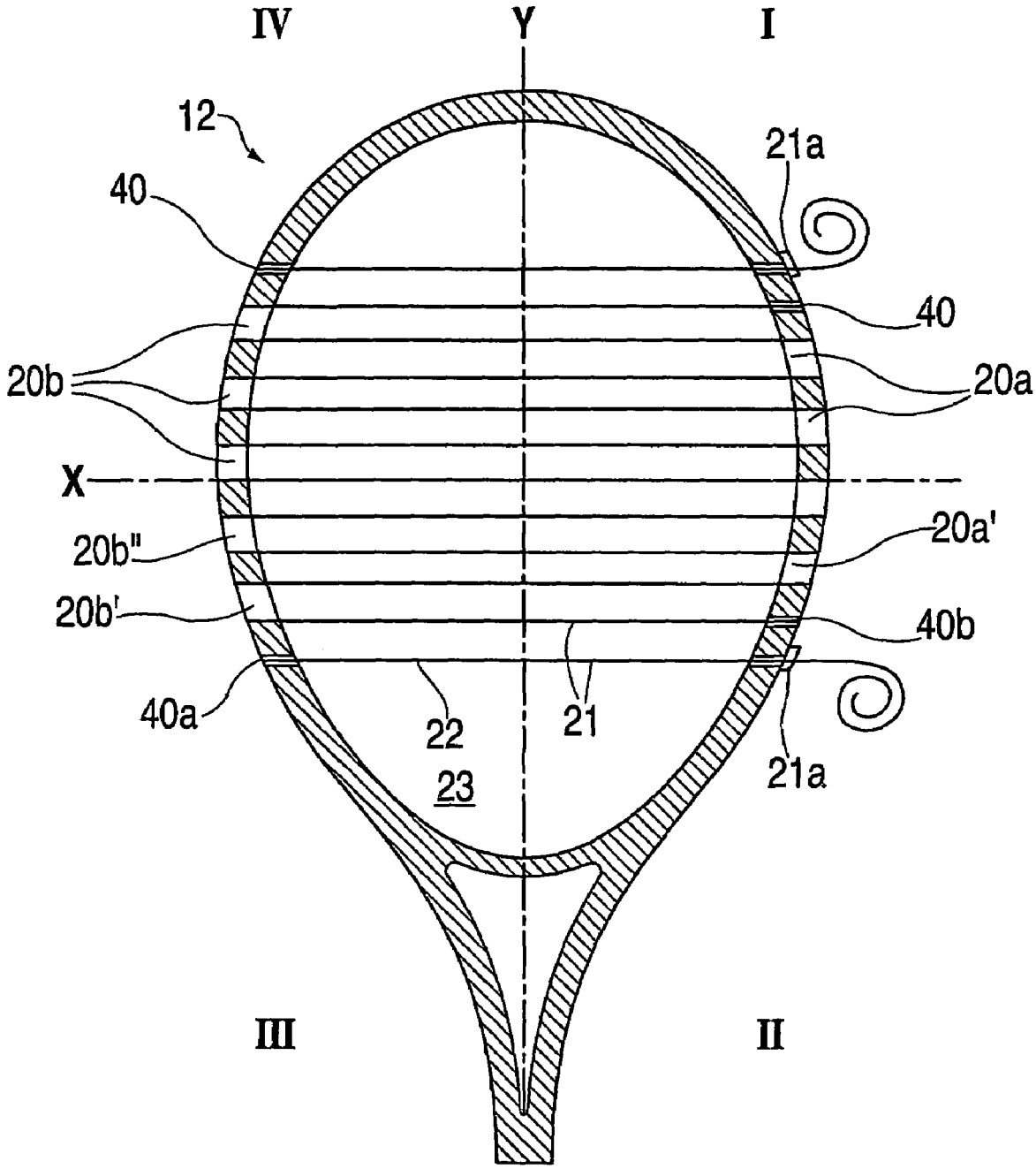
FIG. 3 is a sectional plan view of the frame of FIG. 1.

Stringing of the racquet is facilitated by the large size of the enlarged string holes. FIG. 3 illustrates a portion of a stringing process for a racquet having a plurality of opposed enlarged string holes 20*a* and 20*b* located on opposite sides of the head 12. FIG. 3 reflects the fact that a sports racquet is typically strung with a single string (or with one string for the main strings and a second string for the cross strings). In the partially strung racquet shown in FIG. 3, the tensioned string 21 is secured temporarily by clamps (shown schematically as 21*a*). Starting at the bottom of the head portion, a first cross string segment 22 crosses the string bed opening 23 and extends through a conventional string hole 40*a*. After exiting the hole 40*a*, the string 21 extends along the outside surface of the head portion 12 until reaching the first enlarged string hole 20*b*' on the left hand side of the racquet. The string 21 extends through the first enlarged string hole 20*b*', bearing against the lower wall of the hole 20*b*', and again crosses the string bed opening 23 to the other side of the head portion 12, where the string 21 passes through another conventional string hole 40*b*.

After exiting the hole 40*b*, the string 21 extends along the outside surface of the head portion 12 until reaching the first enlarged string hole 20*a*' on the right hand side of the racquet. The string 21 then passes through the enlarged string hole 20*a*', bearing against its lower wall, and crosses the string bed opening 23 until reaching the first enlarged string hole 20*b*' on the left hand side. The string then passes through the enlarged string hole 20*b*', bearing against the upper wall of hole 20*b*', and extends along the outer surface of the head portion 12 until reaching the second enlarged string hole 20*b*". The string 21 then extends through the second enlarged string hole 20*b*", bearing against its lower wall, crosses the string bed opening 23, and extends through the first enlarged string hole 20*a*', bearing against its upper wall. The process then repeats itself as shown in FIG. 3.

FIG. 3 thus illustrates why, with a string bed formed of longitudinal and lateral strings, it is necessary to stagger the locations of the enlarged string holes 20*a* and 20*b*, i.e., because a string which bears against the lower wall of one enlarged string hole 20*b* must bear against the upper wall of the enlarged string hole 20*a* (or alternatively a conventional string hole 40*b*) on the opposite side of the head. This principle also applies in embodiments where enlarged string holes are used in the tip region and throat bridge. Thus, just as the left and right sides of the racquet in FIG. 3 are not symmetrical, the enlarged string holes in the tip and throat bridge would not be symmetrical. However, if other stringing patters such as diagonal were to be used, it might not be necessary to stagger the opposed enlarged string holes.

It should be noted that FIG. 3 does not necessarily illustrate the preferred stringing method. For example, FIG. 3 shows the racquet partially strung with cross string 21, whereas in actuality it is customary to string the main strings first. Also, FIG. 3 shows the string 21 clamped on the outside of the frame, whereas it is customary to clamp the string, during stringing, on the inside of the frame. FIG. 3 also does not show all of the cross string holes or any of the main string holes. Thus, FIG. 3 is intended merely to illustrate how the string 21 extends between enlarged string holes and how such holes are positioned relative to one another. Persons skilled in the art know how to string racquets, and for such reason it is not necessary to describe a complete stringing process herein.

The shapes of the enlarged string holes can be varied in order to create different design patterns in the frame or for other reasons, such as minimizing the cost of tooling or production.

Figure 4:
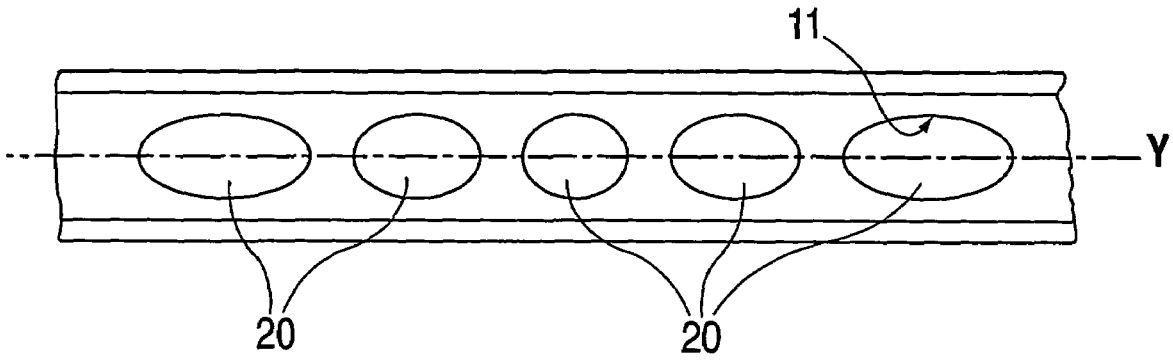
FIGS. 4-7 are side views of a portion of a tennis racquet frame.
Figure 5:
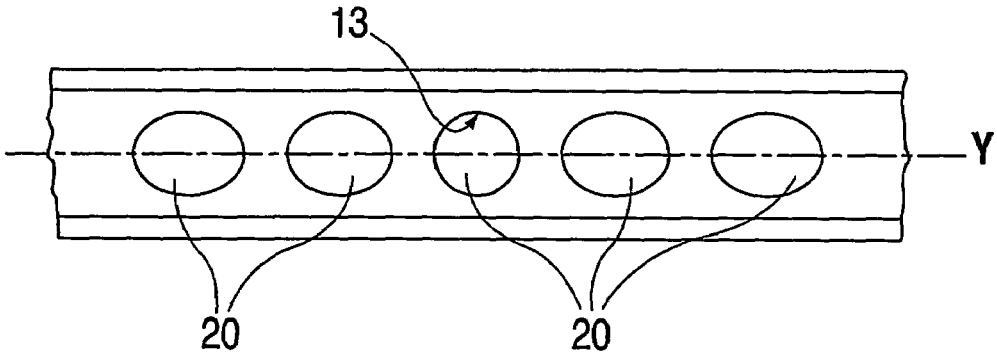

In the embodiment shown in FIG. 4, the enlarged string holes 20 have an elliptical shape 11, in which the major axis is oriented in the plane of the string bed. As an alternate embodiment, some or all of the enlarged string holes 20 can be circular 13, as illustrated by FIG. 5. In either case, the size of the holes 20, and the spacing between holes, is selected to provide the desired spacing between successive string segments.

Figure 6:
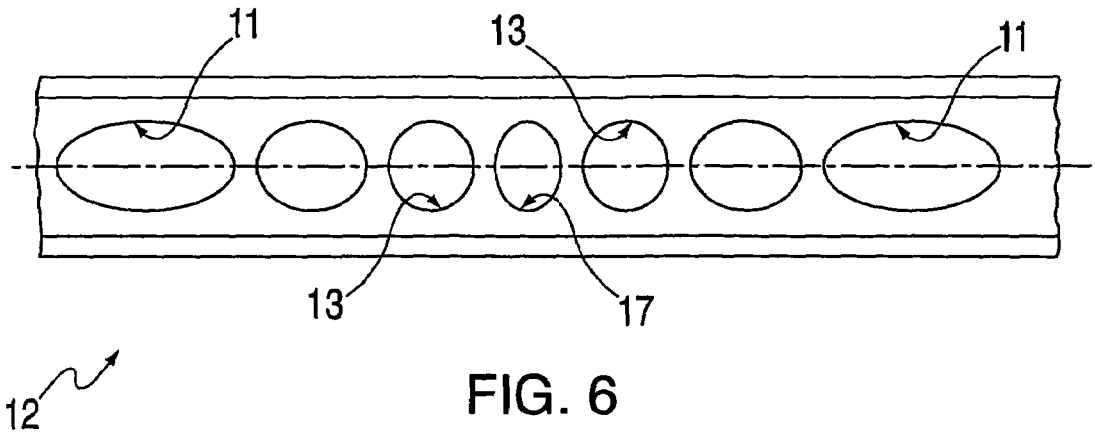

FIG. 6 shows another embodiment, in which the enlarged string holes have a combination of round 13 and elliptical 11, 17 shapes, and in which the major axis of the ellipse can have different orientations (two possible orientations, in which the major axis is oriented in the string bed plane and perpendicular to the string bed plane, are illustrated—other orientations are possible).

Figure 7:
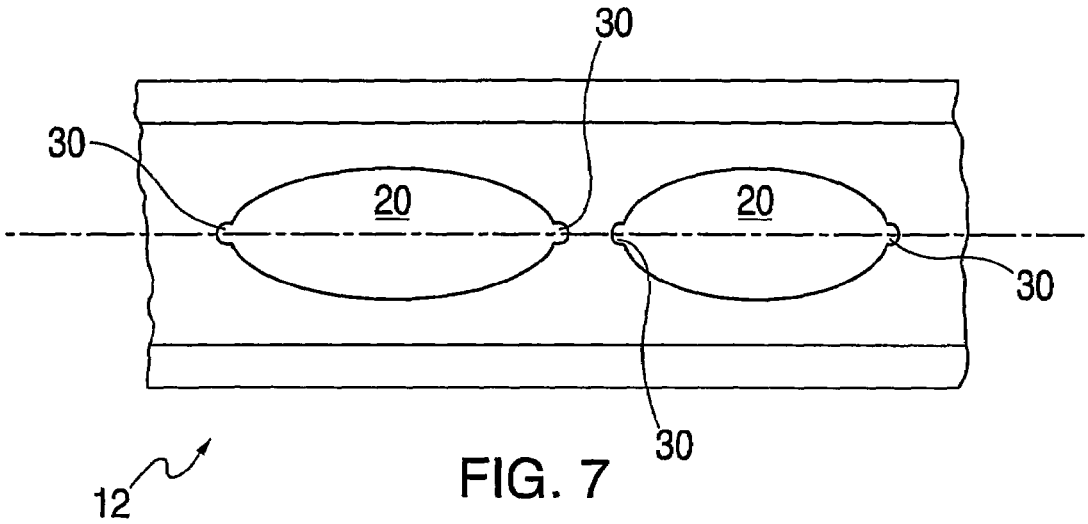
Figure 8:
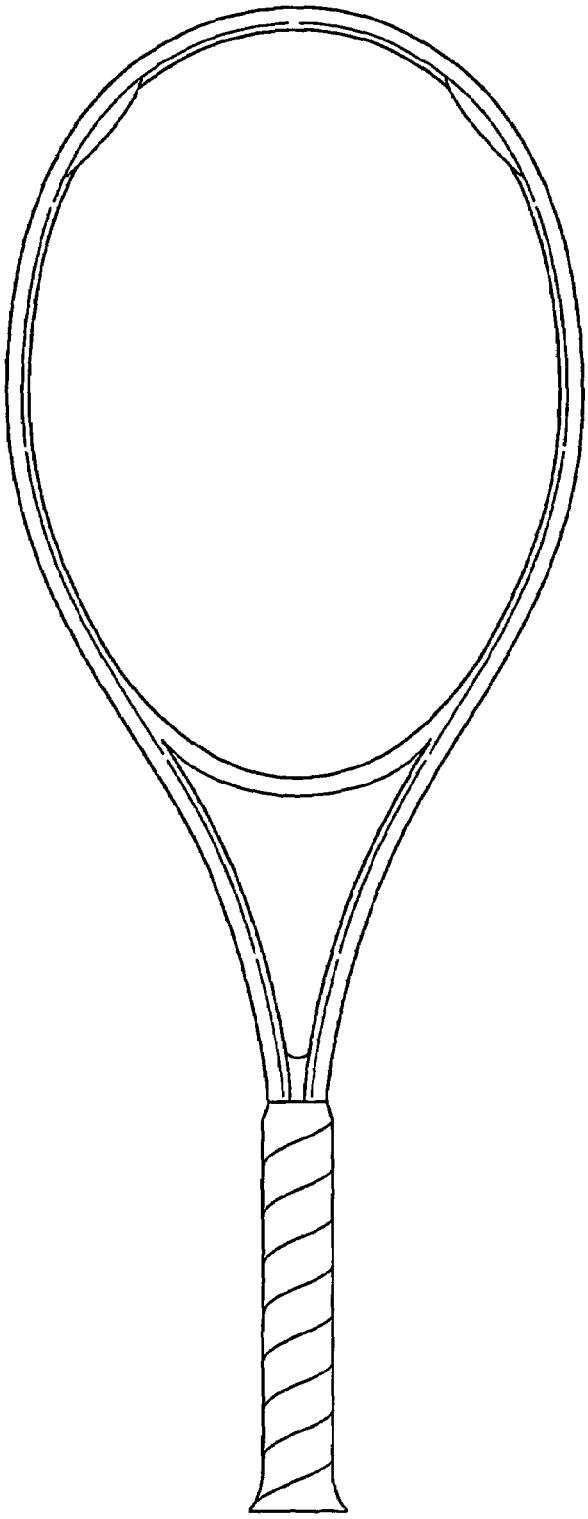
FIGS. 8-9 are plan and side views, respectively, of a racquet according to the invention, unstrung.

Rounded enlarged string holes are self-seating. In other words, when the string is tensioned, it will automatically seat itself against one of the walls of the string hole. However, if desired, the enlarged string holes may include guides for seating the strings, particularly at the outer lip where the strings enter the string hole from the outside surface of the frame. In this manner, undesirable movement between the strings and frame can be prevented. By way of illustration, FIG. 7 shows guides in the form of opposed guide grooves 30 which are molded in the frame on the interior of the enlarged string holes 20, at either end thereof, to secure the strings against movement. The grooves 30 preferably have a substantially cylindrical shape with a diameter somewhat larger than the largest gauge string used in that type of racquet. The grooves 30 may have other suitable shapes.

The guide grooves 30 can extend through the entire enlarged string hole 20, i.e., from the outside surface of the frame to the inside surface of the frame, thereby preventing any string movement within the holes 20. Alternatively, the guides for the enlarged string holes can be designed to restrain string movement only near the outer lip, while allowing the strings to move inside the hole, upon ball impact, in the manner disclosed in U.S. Pat. No. 5,944,624. In such a case, the end walls of the enlarged string holes would preferably be flat and oriented perpendicular to the string bed to allow the strings to deflect upon ball impact.

As another alternative, the strings can be constrained against movement, either at the lip of the enlarged string holes, or within the hole itself, by a plastic guide member, such as a grommet strip, which is secured within the holes. In the case where the enlarged string holes 20 are drilled into the frame, such that the lip of the hole presents a sharp surface that could damage a string, it is preferable to guide the string with a plastic grommet strip. Also, in the tip region of the racquet, it is preferable to employ a plastic bumper strip to protect the frame from damage upon impact with the ground or other surface, which can be used to secure the strings in a manner similar to that used with conventional racquets.

FIGS. 8-14 illustrate another embodiment according to the present invention. FIGS. 8-9 and 10-11 show an unstrung racquet having a head portion 30, a handle 32 with a grip wound thereon, and a pair of shaft portions 34 connecting the head portion 30 and handle 32. A throat bridge 36 completes the oval stringing area.

Figure 12:
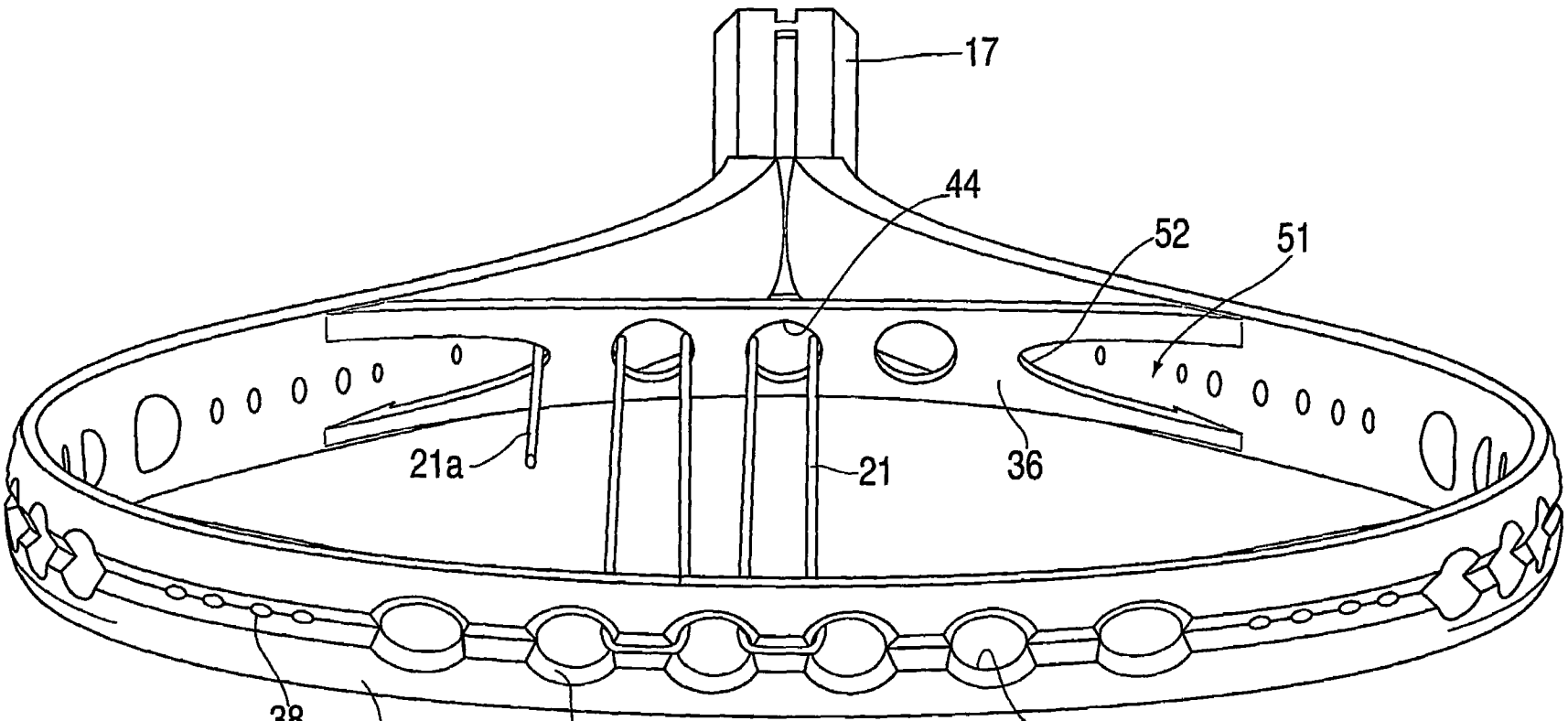
FIGS. 12-14 are perspective views of the racquet of FIGS. 8-9.

As shown in FIGS. 9 and 10-14, the head portion includes a plurality of conventional string holes 38 and a plurality of enlarged string holes 40. FIG. 12 shows six enlarged string holes 42 in the tip, and three enlarged string holes 44 in the throat bridge 36. FIG. 12 also shows that the opposite ends of the throat bridge 36 are split from one another to form a central channel 51 for passage of outlying main strings to the main frame. This has the effect of increasing the effective length of such strings, increasing their power. As shown, the base 52 of each channel 51 forms a bearing surface for a string segment 21*a*. Thus, in this example, eight main string segments extending from the enlarged string holes 42 in the tip are secured in the throat bridge 36, and the remaining main string segments extending from the enlarged string holes 42 are secured in conventional string holes 38 in the sides or lower corners of the frame.

Figure 13:
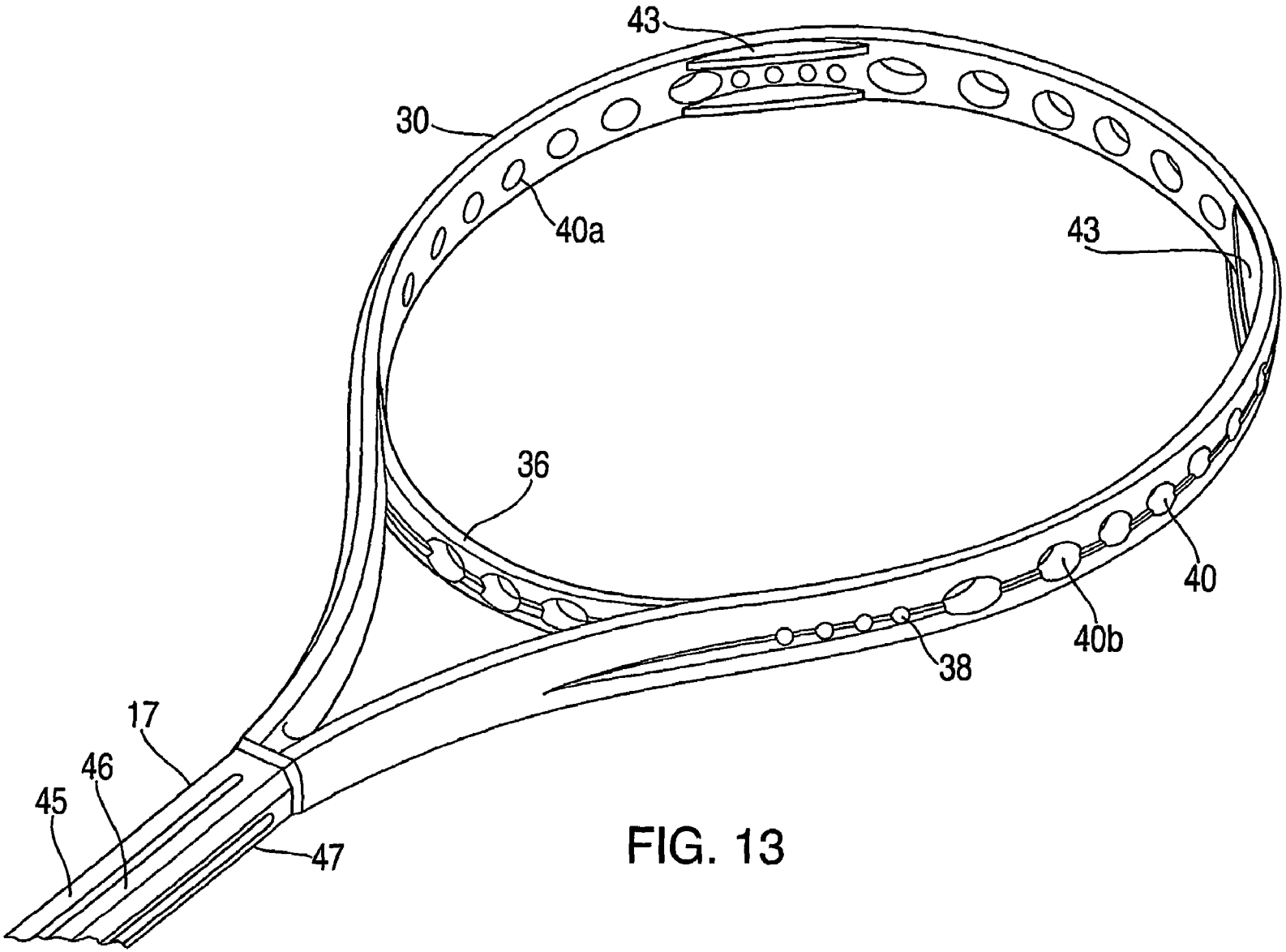
Figure 14:
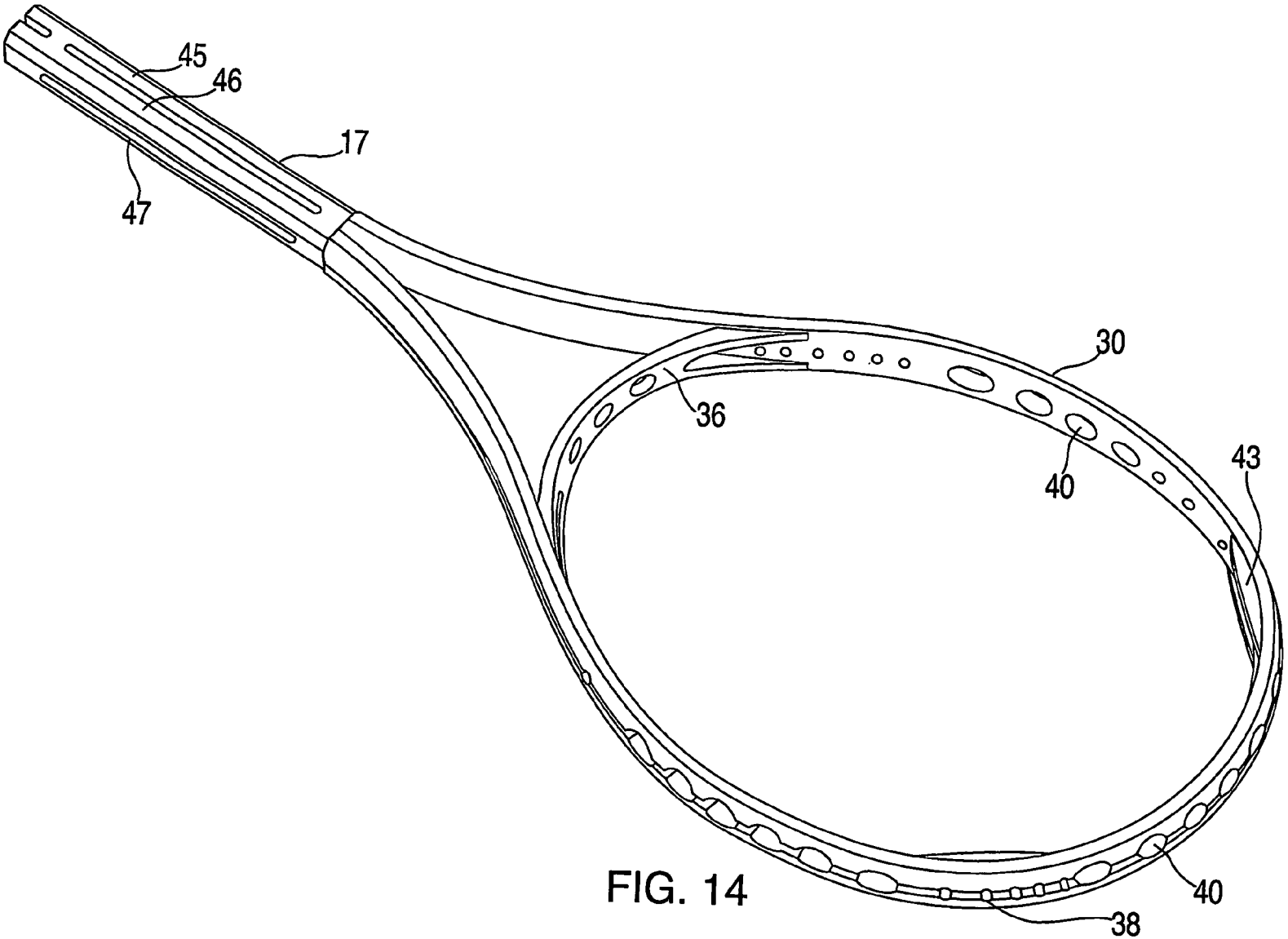

As shown in FIGS. 13-14, the sides of the frame each have seven enlarged string holes 40. However, as described before, the hole locations are staggered, such that the upper walls of the enlarged string holes 40*a* on one side of the frame are aligned with the lower walls of the enlarged string holes 40*b* on the opposite side of the frame.

As shown in FIGS. 13 and 14, a racquet according to this embodiment may include bulges 43 in the upper corners of the racquet, e.g., at approximately the 1 o'clock and 11 o'clock positions of the head. Such bulges 43 can be used to add weight at these positions to increase the center of percussion (sweet spot) and polar moment of inertia of the racquet. The use of such bulges is optional and forms no part of the invention per se. Finally, if desired the handle portion of the frame 45 may be molded so that the two ends 45, 46 of the upper tube element are separated from one another and also separated from the two ends (one of which, 47, can be seen in FIG. 13) of the lower tube element.

Figure 15:
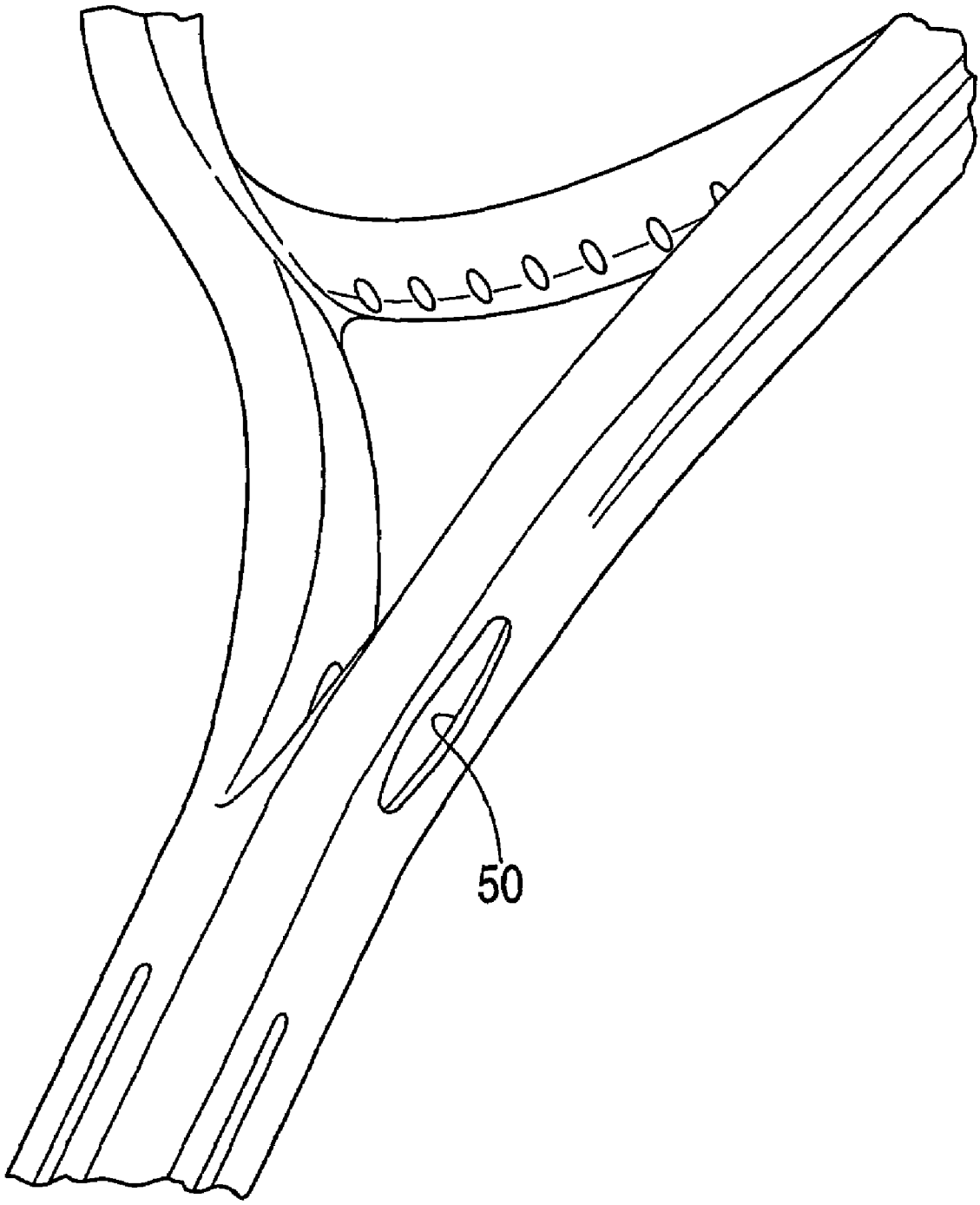
FIG. 15 is a perspective view of the throat portion of a racquet frame showing an alternative positioning for an enlarged hole in which an elastomeric damping material may be positioned.

As shown in FIG. 15, if desired enlarged openings 50 may be formed in other parts of the racquet frame, such as the shafts, in order to reduce weight or house damping elements.

Figure 16:
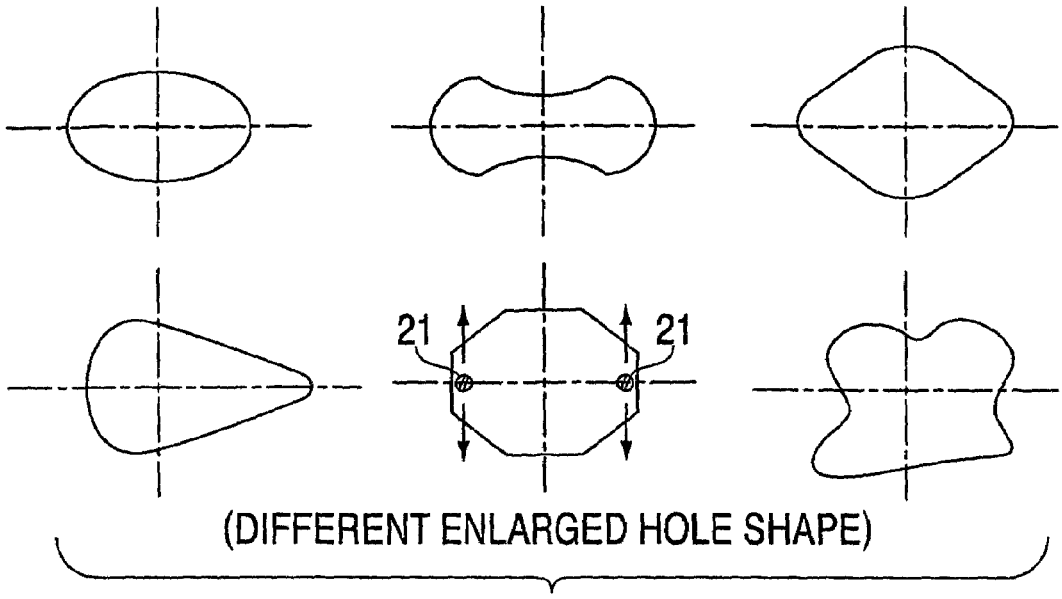
FIG. 16 illustrates various shapes that can be used for enlarged string holes.

FIG. 16 shows, on an enlarged scale, various shapes of enlarged string holes that may be employed. As shown, such shapes can include ones where the opposite end walls are parallel and oriented perpendicular to the string bed such that, upon ball impact, the strings 21 can be deflected in a direction perpendicular to the string bed, as shown by the arrows. After the ball leaves the string bed, the strings would rub against the end walls, damping string vibration, as described in U.S. Pat. No. 5,944,624.

Preferably, the racquet frame is formed in accordance with a process described in U.S. published patent application No. US2003/0162613, the specification and drawings of which are incorporated herein by reference. In such a process, a pair of hollow prepreg tubes of uncured composite material are placed in a common mold to form, respectively, upper and lower frame halves. Prior to closing the mold, a plurality of metal pins are positioned between the upper and lower tubes, in the locations where string holes are desired. The pins are secured such that they cannot move after the mold is closed. The mold is then closed, and the tubes are inflated into the shape of the racquet. At the same time, the mold is heated in order to cause the composite material to cure.

In a method for making a composite sports racquet frame according to the invention, a mold is provided having first and second mold plates which, when joined, define a mold cavity in the shape of a sports racquet. A first tube of a material suitable for fonning a racquet frame, such as a fiber-reinforced resin, is placed in the first mold plate. A second tube of such material is placed in the second mold plate. A plurality of pin plates, each having a plurality of pins which are preferably at least substantially parallel to one another, are secured to the first mold plate so that the pins lie on top of the first tube.

After coupling a compressed air source to each of the tubes, the mold plates are secured to one another so that the first and second tubes contact one another at least in the regions to either side of the pins. The mold is then heated, while at the same time pressurizing the tubes, to form a racquet frame in which the tubes are joined to one another at least in the regions adjacent to the pins.

Preferably, the tubes are made of a composite material having a component, such as epoxy resin or thermoplastic, which, when subjected to the heat and pressure of the mold, will flow. In this manner, during molding the contacting portions of the two tubes will fuse together to form a common, integral, internal wall.

After the molded frame has been removed from the mold plates, the pins are pulled out of the frame, the pins thereby forming string holes in the frame.

Preferably, the pin plates forming the string holes in the head portion of the racquet are disposed on the outside surface of the head portion, so that the pins project inwardly. The base of the pins, i.e., where the pin project from the pin plates, are contoured so that the string hole openings formed by the pins along the outside surface of the racquet are rounded, thereby reducing the chance of string breakage.

Preferably, the tubes, when in the mold, alternately contact one another and a pin along the entire head portion of the frame. Preferably, the ends of the tube which will form the racquet handle portion are kept separated from one another during molding, by using a removable mold plate.

Also, preferably, the inner surface of the pin plates, from which said pins project, forms part of the mold cavity, e.g., to define a string groove extending along the outside of the head portion of the frame between string holes.

During molding, the abutting walls of the upper and lower tubes fuse together to form one common wall, except where the pins keep the walls separated from one another. After molding, the pins are withdrawn from the frame. In such a manner, the string holes are formed during molding. This frame formation method is very desirable because, unlike conventional methods, string holes do not need to be drilled through the frame after molding (which requires additional labor and can weaken a racquet frame). It is also desirable because the common internal wall formed during molding underlies the string segments on the outside surface of the frame and thereby strengthens the racquet against potential string pull-through problems. Also, the pins can be contoured at the outer edge of the string holes, so that the entrance to the string holes is rounded. Thus, plastic grommets, which are required in the case of drilled string holes in order to protect the strings from the sharp edges of the string holes, may not be needed. Such method is also desirable because it reduces the costs associated with making of the frame.

A racquet frame according to the present invention can be made according to the process described above except that, in place of pins, mold elements are used which are shaped to form the enlarged string holes at the desired locations.

Figure 9:
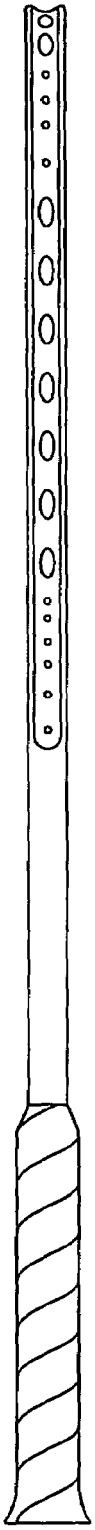
Figure 9A:
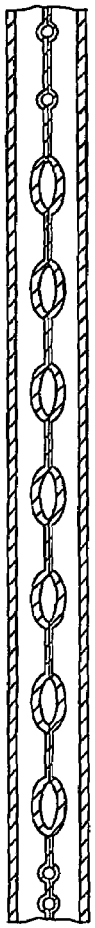
FIG. 9*a* is a sectional side view of a portion of the frame shown in FIG. 9, in the direction of arrows 9*a*-9*a;*
Figure 9B:
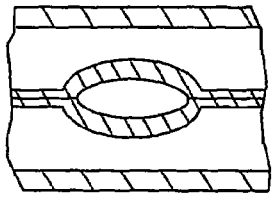
FIG. 9*b* is a detail of the frame shown in FIG. 9*a;*
Figure 10:
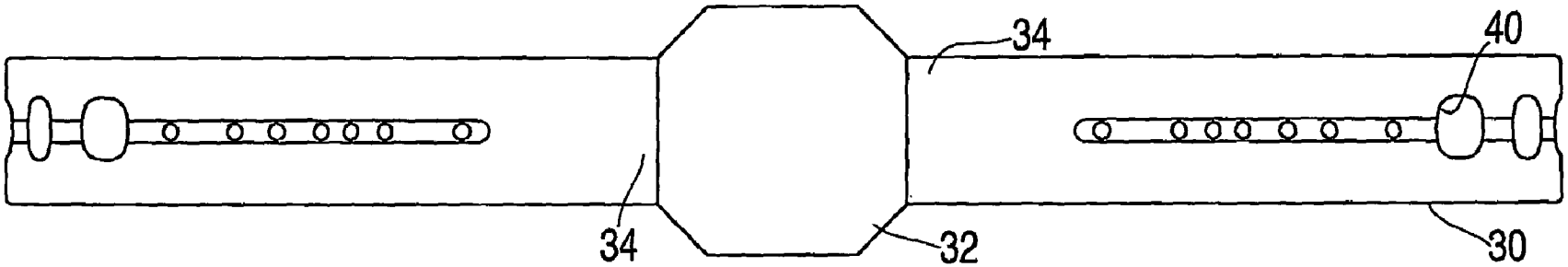
FIGS. 10 and 11 are bottom and top views, respectively, of the racquet of FIGS. 8-9.
Figure 11:
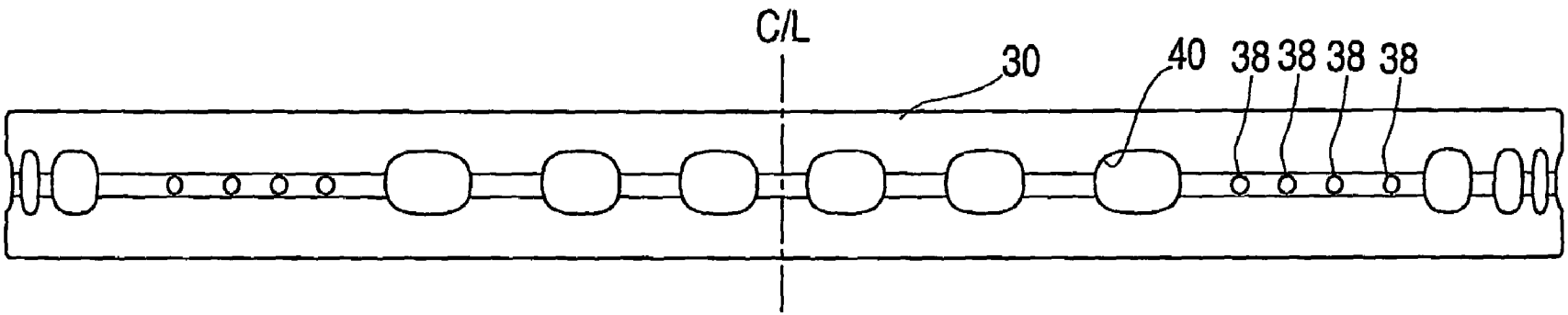

Referring again to FIGS. 9*a*-9*b*, when a racquet is made according to the above-described process, the portions of the upper and lower tubes facing one another fuse together, to form a common inner wall 100, except where string holes 38, 40 are formed. In the regions between the enlarged string holes 40, where the racquet strings bear against the outer surface of the frame, the common wall 100 forms a strong internal structural member preventing string pull-through. In the regions containing the enlarged string holes 40, there is no force applied by the strings against the outer surface of the frame. Thus, the facing wall sections 102, 104 do not need to resist string pull-through. However, as shown in FIGS. 9*a*-9*b*, the facing walls 102, 104 diverge from one another, away from the center string bed plane, not only to form enlarged string holes 40, but also to form an internal truss-like structure, which is oriented perpendicular to the string bed and which imparts additional strength and bending resistance to the frame.

Figure 18:
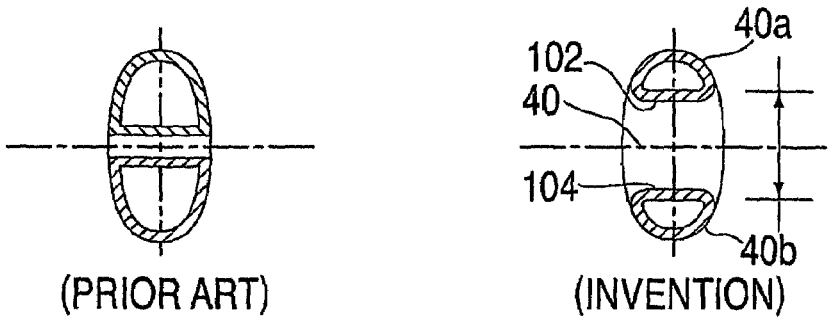
FIG. 18 is a cross-sectional view of a two-tube racquet frame comparing a string hole according to the prior art with a string hole according to the invention.

FIG. 18 shows a cross-section of a string hole molded in accordance with U.S. Published Patent Application No. US 2003/0162613 (labeled "Prior Art") compared to an enlarged string hole 40 molded in accordance with the present invention. As shown, the perimeter of each tube 40*a*, 40*b* forming the string hole 40 is smaller in the case of the present invention than the perimeter of the tubes forming a conventional string hole. Thus, less material can be used to attain the same strength. And, as described in connection with FIGS. 9*a*-9*b*, the facing walls 102, 104 also add to the strength of the frame, thereby further permitting a reduction in the amount of material used. For both reasons, the present invention allows the weight of the head portion of the racquet to be reduced.

A racquet according to the invention can also be made according to the processes described in U.S. Pat. No. 6,071,203. Such racquet frame also is formed of a pair upper and lower tube halves. However, the tubular frame halves are molded individually and then glued together. The facing surfaces of the two racquet halves are molded to form part of the string holes such that, when the two halves are joined, string holes are formed. Such process, if used to make a racquet according to the present invention, would be modified such that the facing walls of the two tubular frame halves define enlarged string holes when the two halves are joined.

Figure 17:
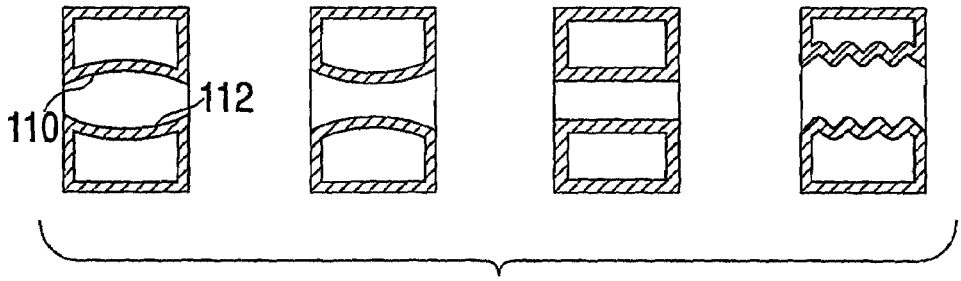
FIG. 17 shows cross-sectional views of the racquet frame, at the location of the enlarged string holes, for variously shaped holes.

FIG. 18 shows one example of the cross-section of an enlarged string hole 40 in which the wall of the hole 40 is cylindrical. FIG. 17 shows various alternative cross-sections through the two tube racquet frame at the point where the enlarged string holes are formed. As shown, the facing walls 110, 112 of the upper and lower tube members can have a variety of shapes. However, certain shapes where the opposed walls are not flat, such as the first and fourth shapes shown in FIG. 17, which require undercuts, are more difficult to mold using the pin molding process described above, e.g., would require a technique such as using a sacrificial mold. Such shapes are more easily created using a process in which the frame halves are molded separately.

If desired, a racquet according to the invention can be made by other methods. For example, the frame can be molded from a single tube of prepreg, in a conventional manner, and conventional size string holes and enlarged string holes can be drilled through the frame after molding. Or, the frame can be formed by injection molding of composite material containing short, chopped fibers, in accordance with another known process. In the case of racquets made of metal, the frame can be formed in a conventional manner, e.g., by extruding the frame, and then drilling the string holes and enlarged string holes.

Figure 19:
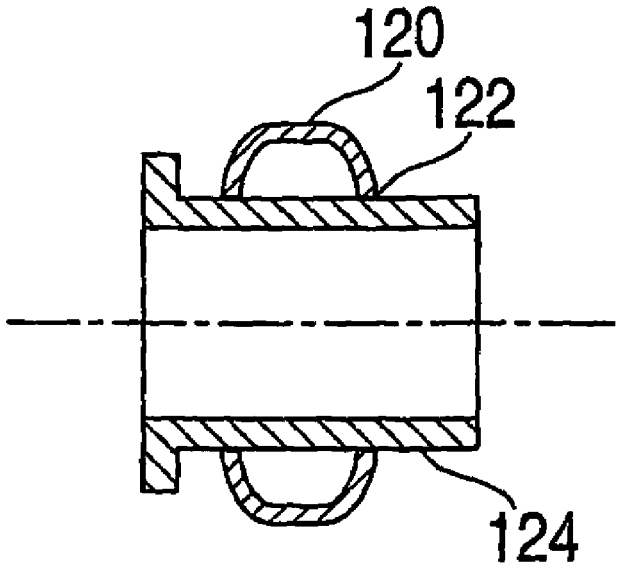
FIG. 19 is a cross-sectional view of a portion of a racquet frame and a grommet according to another embodiment of the invention.
Figure 20:
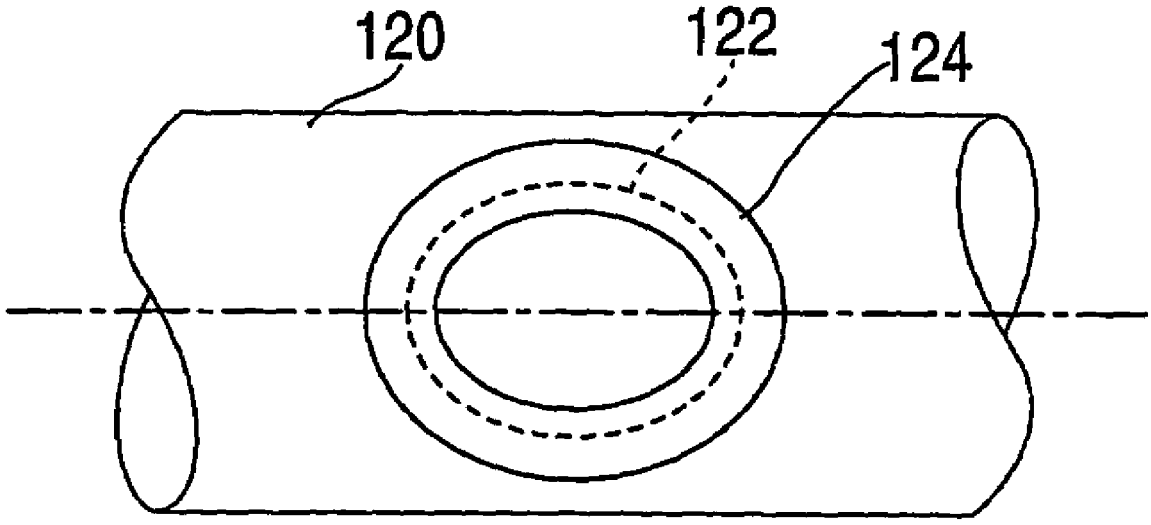
FIG. 20 is a side view of a the racquet frame and grommet of FIG. 19.

FIGS. 19-20 show a racquet frame which has been formed in a conventional manner, out of a single frame tube 120. The enlarged string holes 122 are then formed by drilling through the outer wall of the tube 120. An enlarged plastic grommet 124 is inserted through the string holes 122 to protect the strings from the sharp edges of the holes 122.

The improvements described herein make it possible to achieve a significant reduction in the weight of the frame. The enlarged string holes make it easier to string the racquet and make it possible to optimize the tensions of the strings on the frame. The invention further makes possible innovative designs for the shape of the frame without diminishing the mechanical properties and thus the performance of the racquet.

Figure 21:
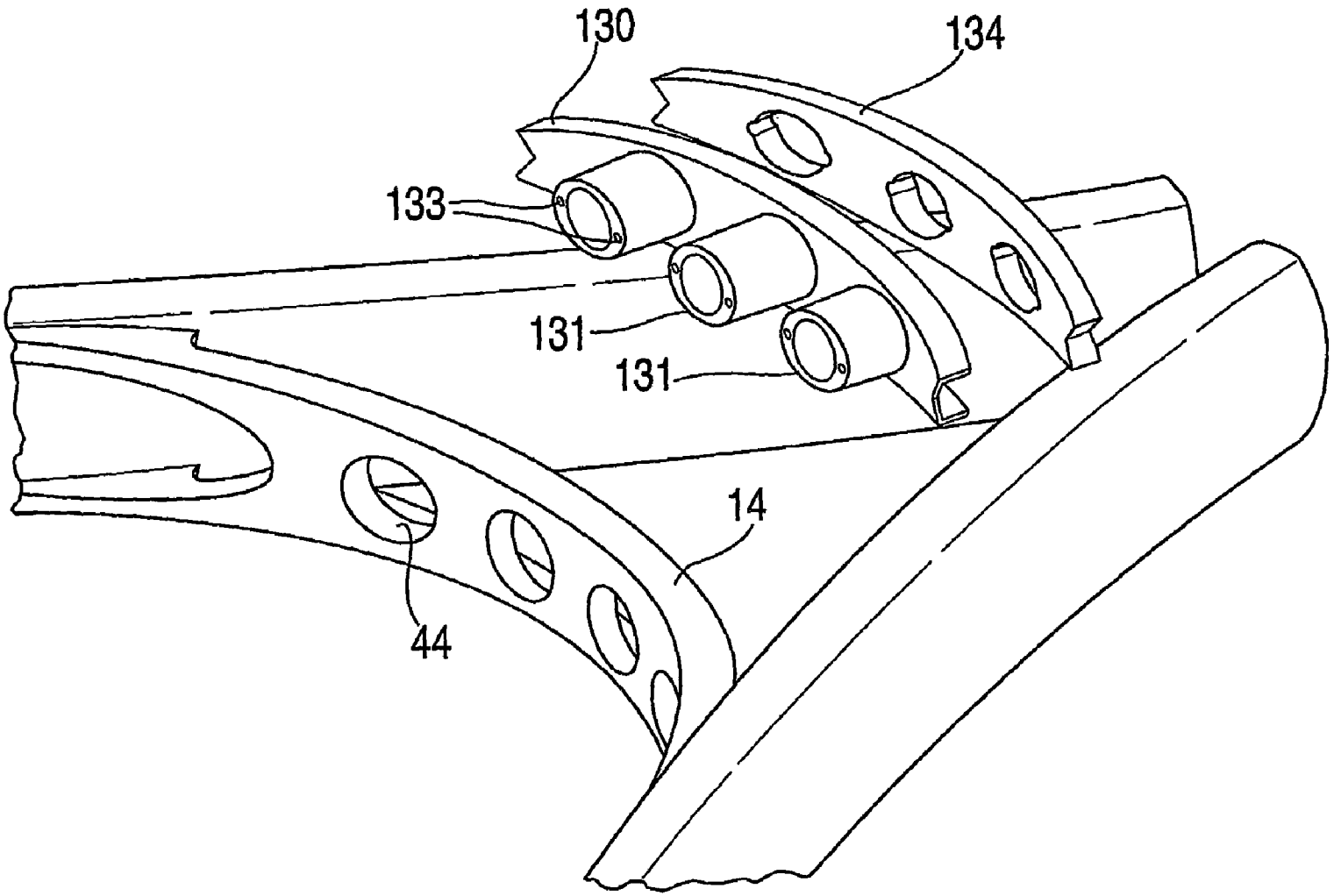
FIGS. 21-22 are perspective views of the throat portion of a tennis racquet according to the invention.
Figure 22:
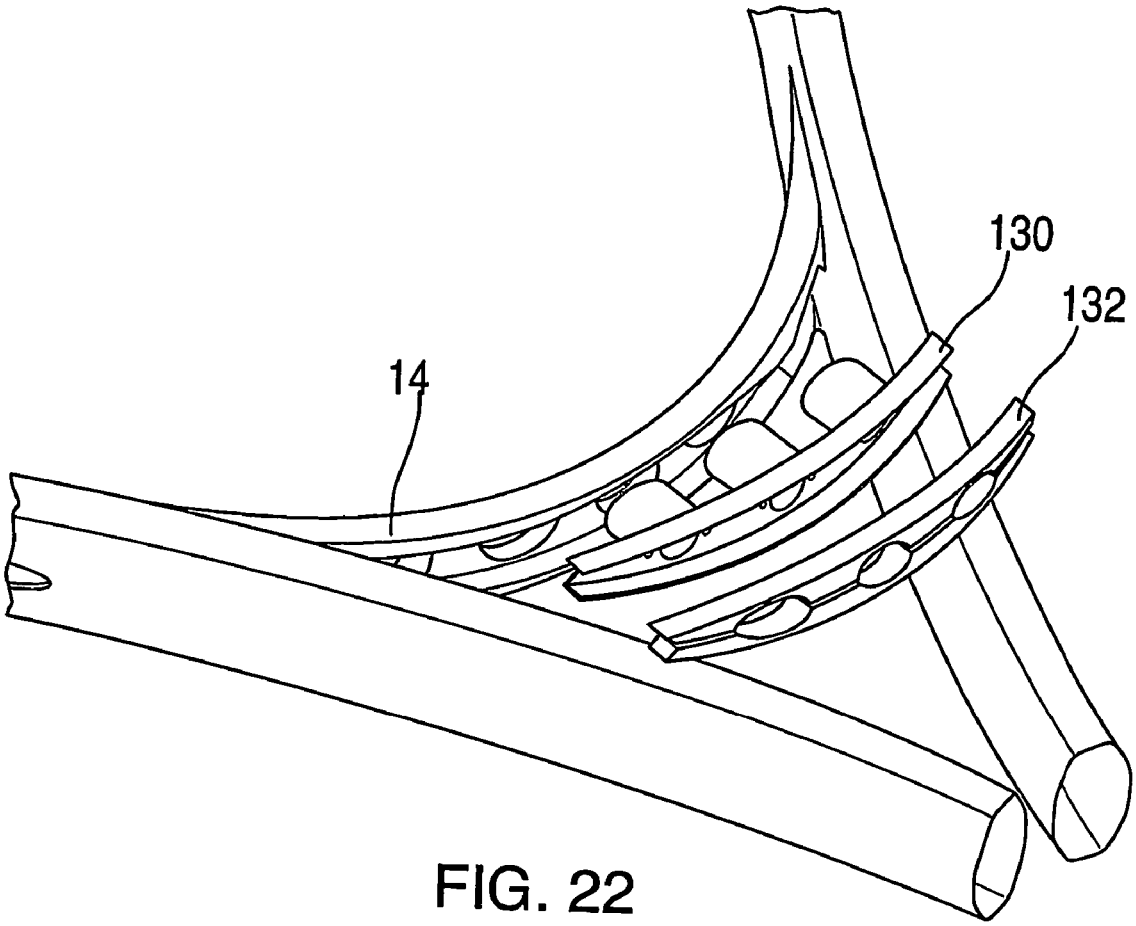
Figure 23:
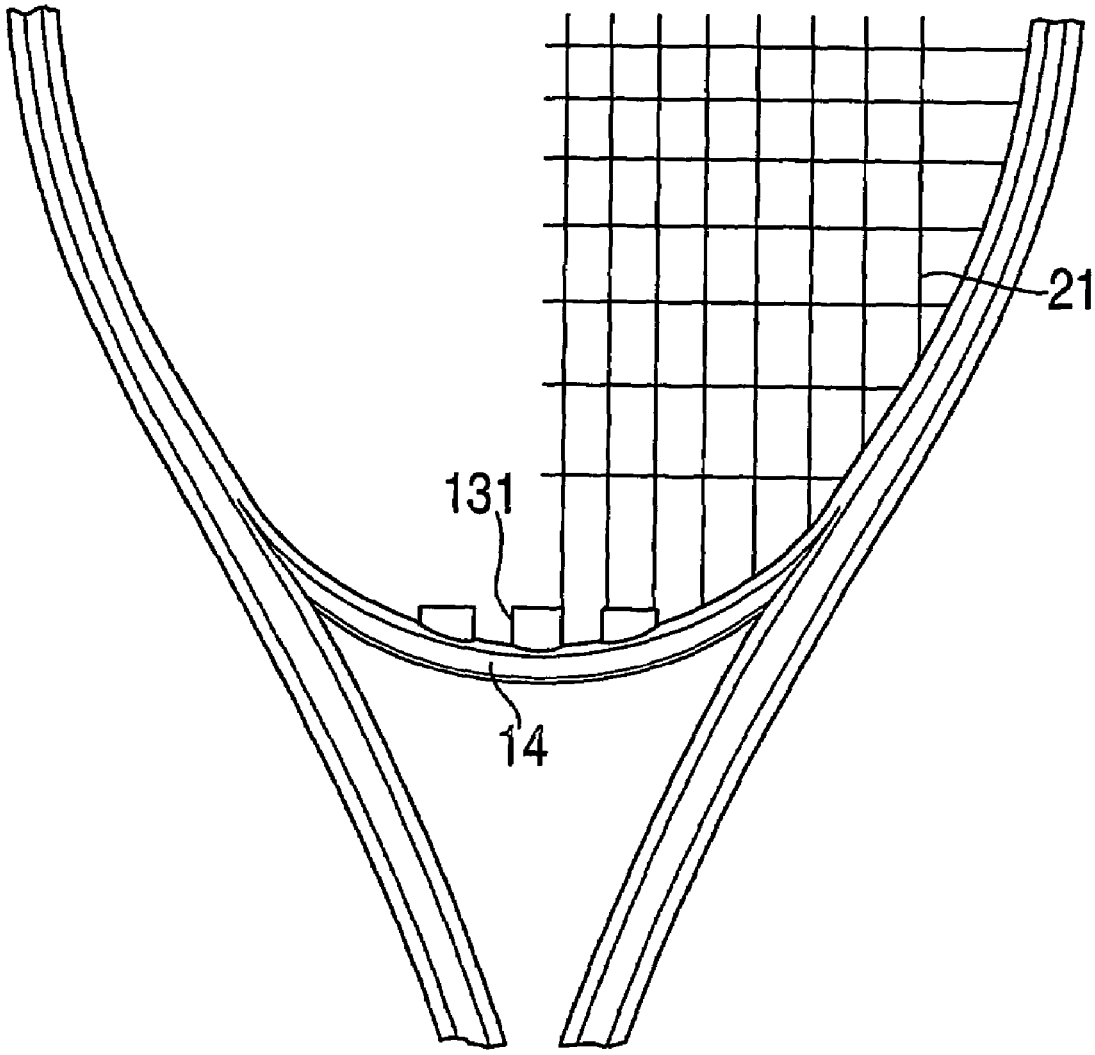
FIGS. 23 is a plan view, and FIGS. 24-25 perspective views, of the racquet of FIGS. 21-22, shown partially strung.
Figure 24:
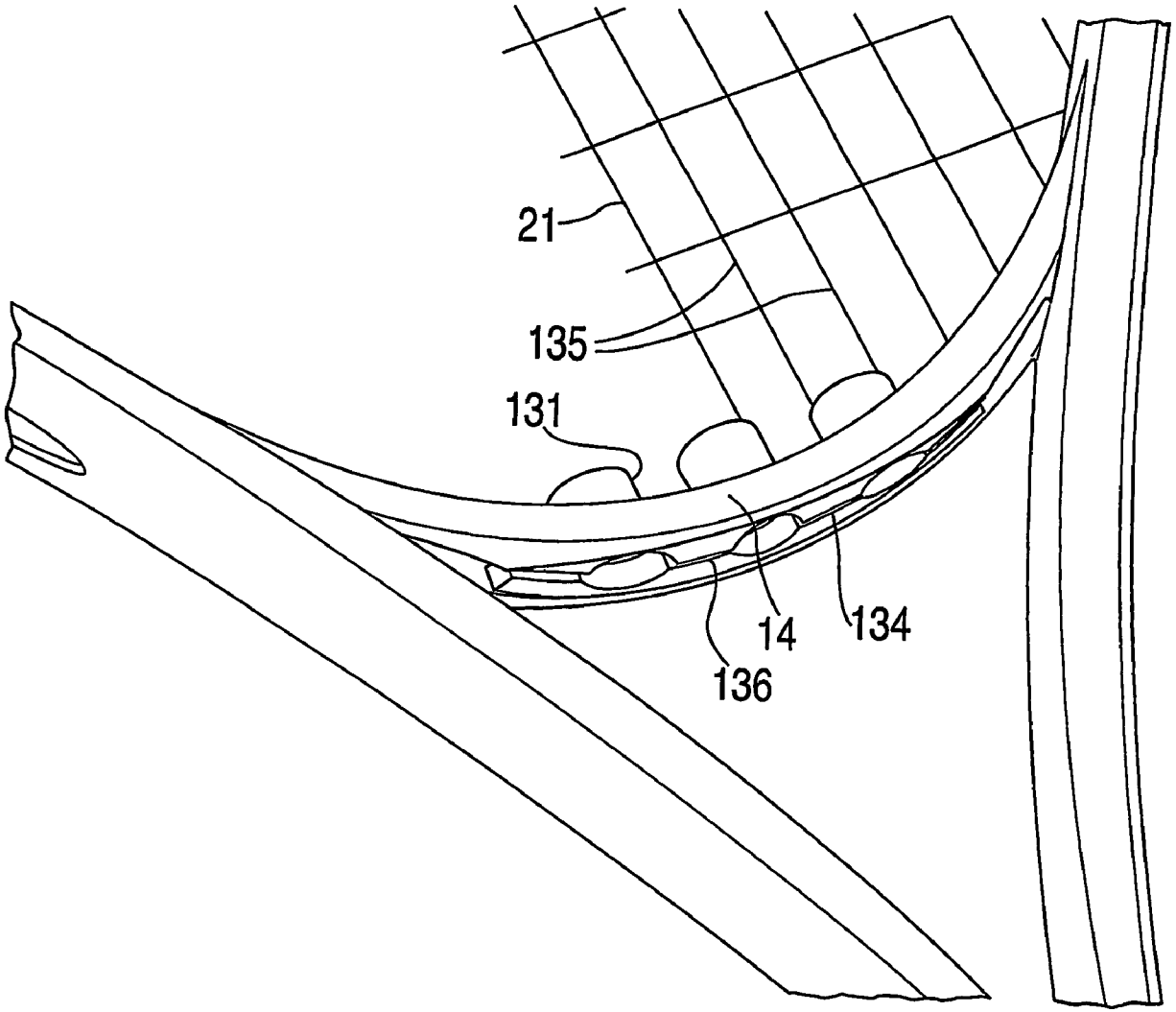
Figure 25:
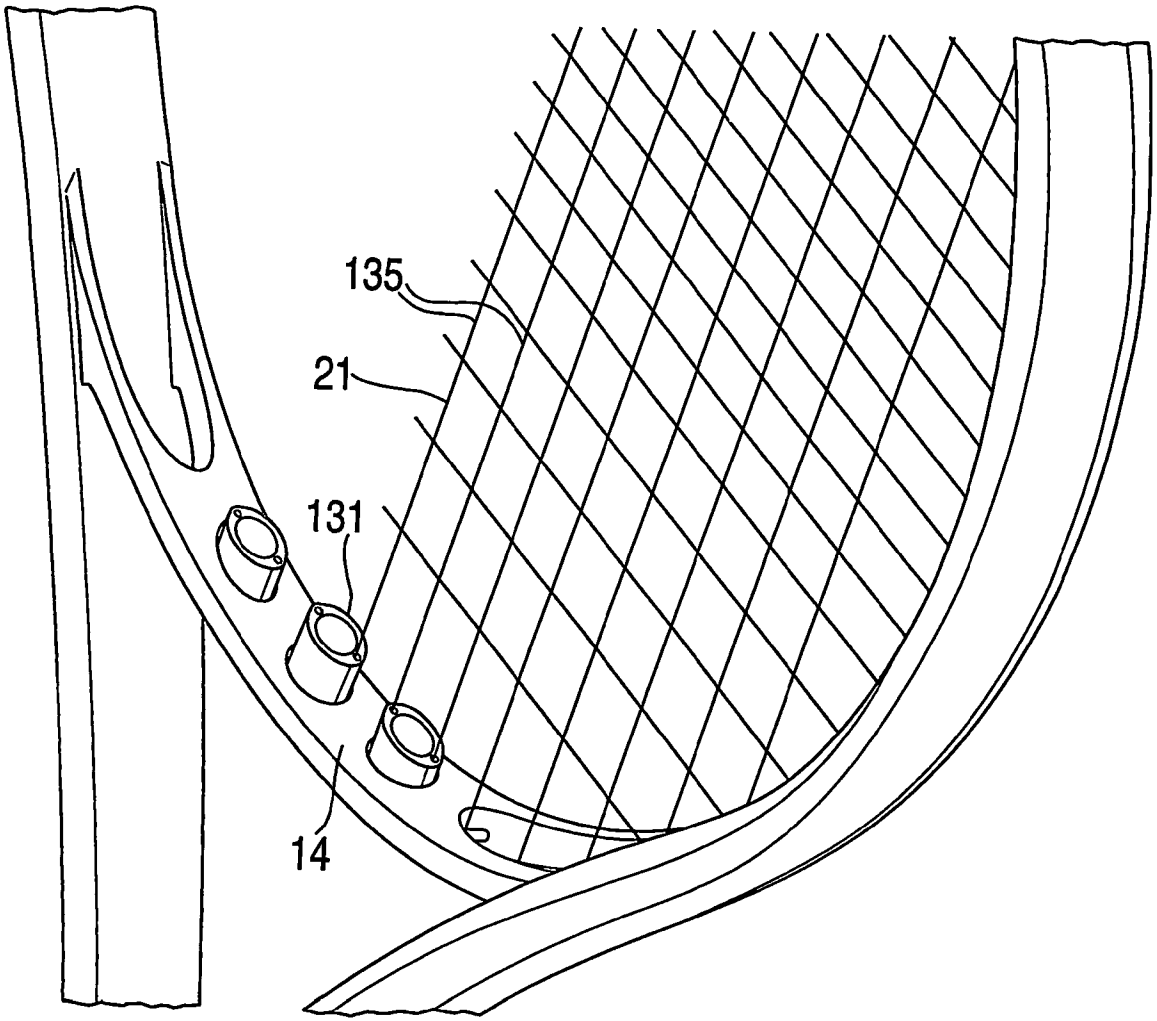

FIGS. 21-25 illustrate another aspect of the present invention. As shown in FIGS. 21-22, a grommet strip 130 includes grommets 131 that extend through the enlarged string holes 44 in the throat bridge 14. The grommet strip 130 can be made of a vibration damping, elastomeric material such as thermoplastic rubber. Each grommet 131 includes a pair of small holes 133 for receiving a portion of a string segment. An outer guide strip 134 overlies the grommet strip 130. The outer guide strip 134 can be made of a harder material, such as nylon. As shown in FIG. 24, the center main string segments 135 extend through the grommets 131, and bear against the outwardly facing surface of the outer guide strip 134. The outer guide strip 134 preferably has a guide groove 136 for seating the string. In such a manner, the grommets 131 act to damp both string and frame vibration.

Figure 26A:
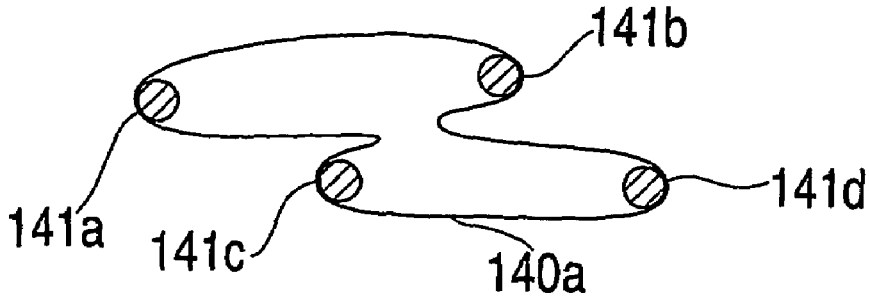
FIGS. 26*a*-26*c* illustrate enlarged string holes that may be employed in the corners of the frame.
Figure 26B:
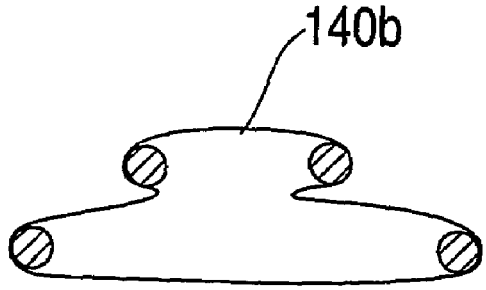
Figure 26C:
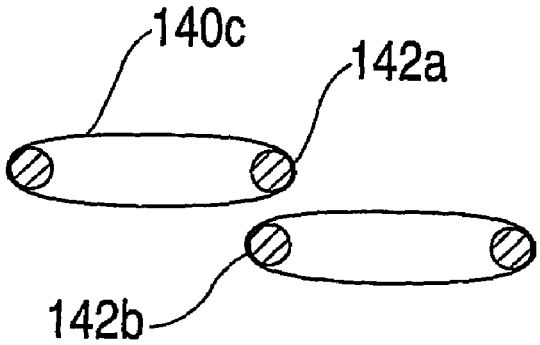
Figure 27:
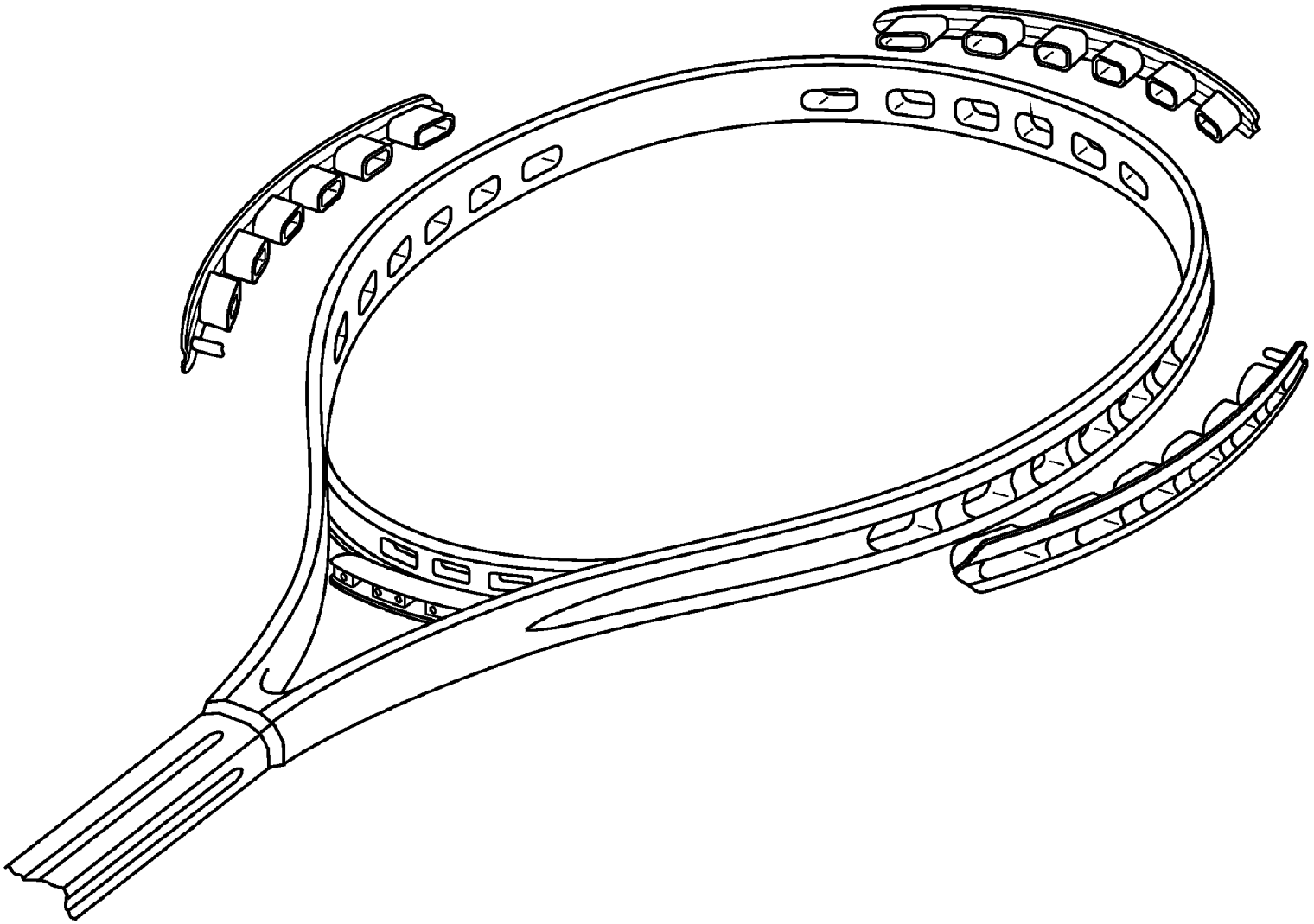
FIGS. 27-30 show various configurations of grommets and grommet strips used for various shaped holes, both with and without grommet strips.
Figure 28:
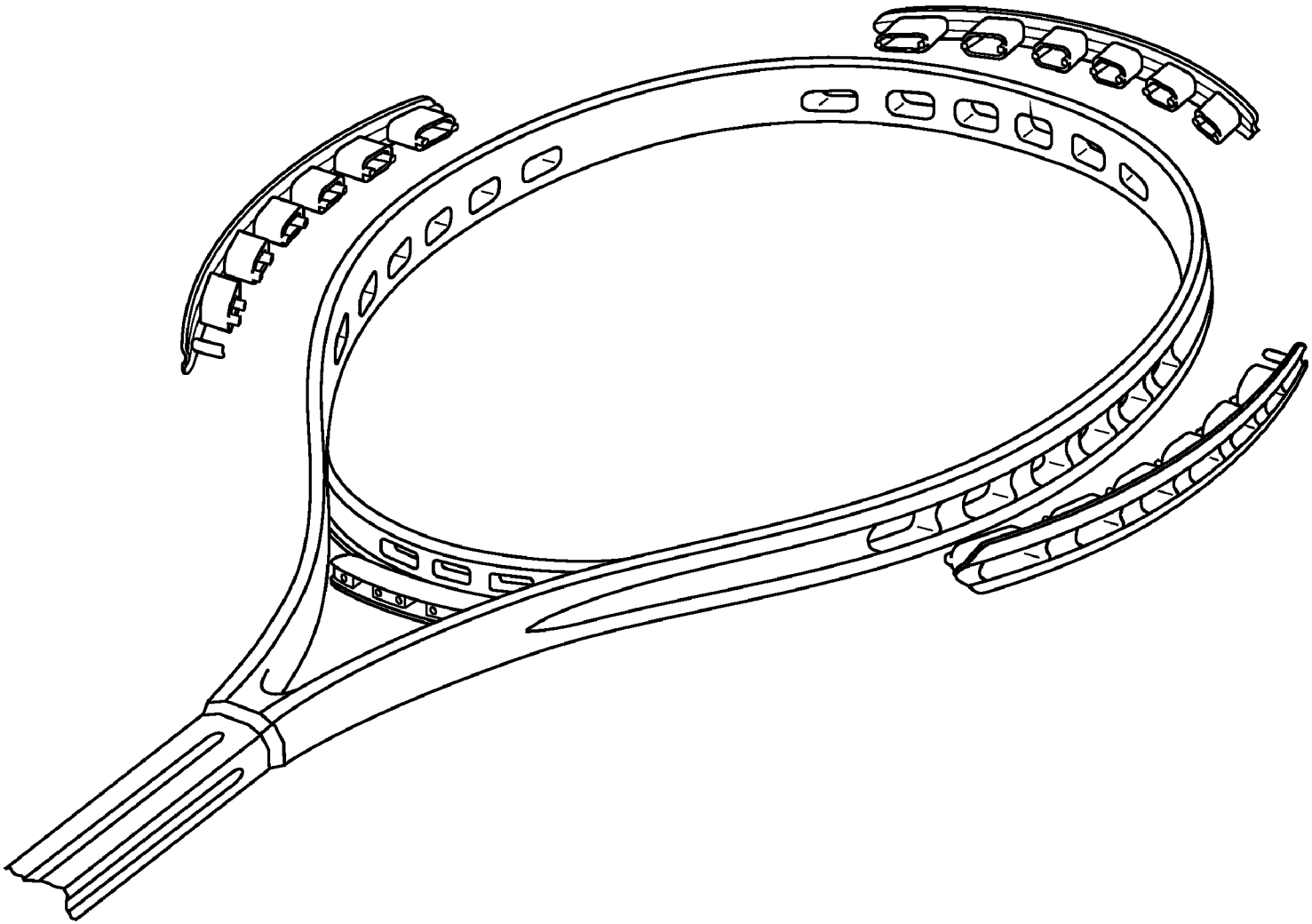
Figure 29:
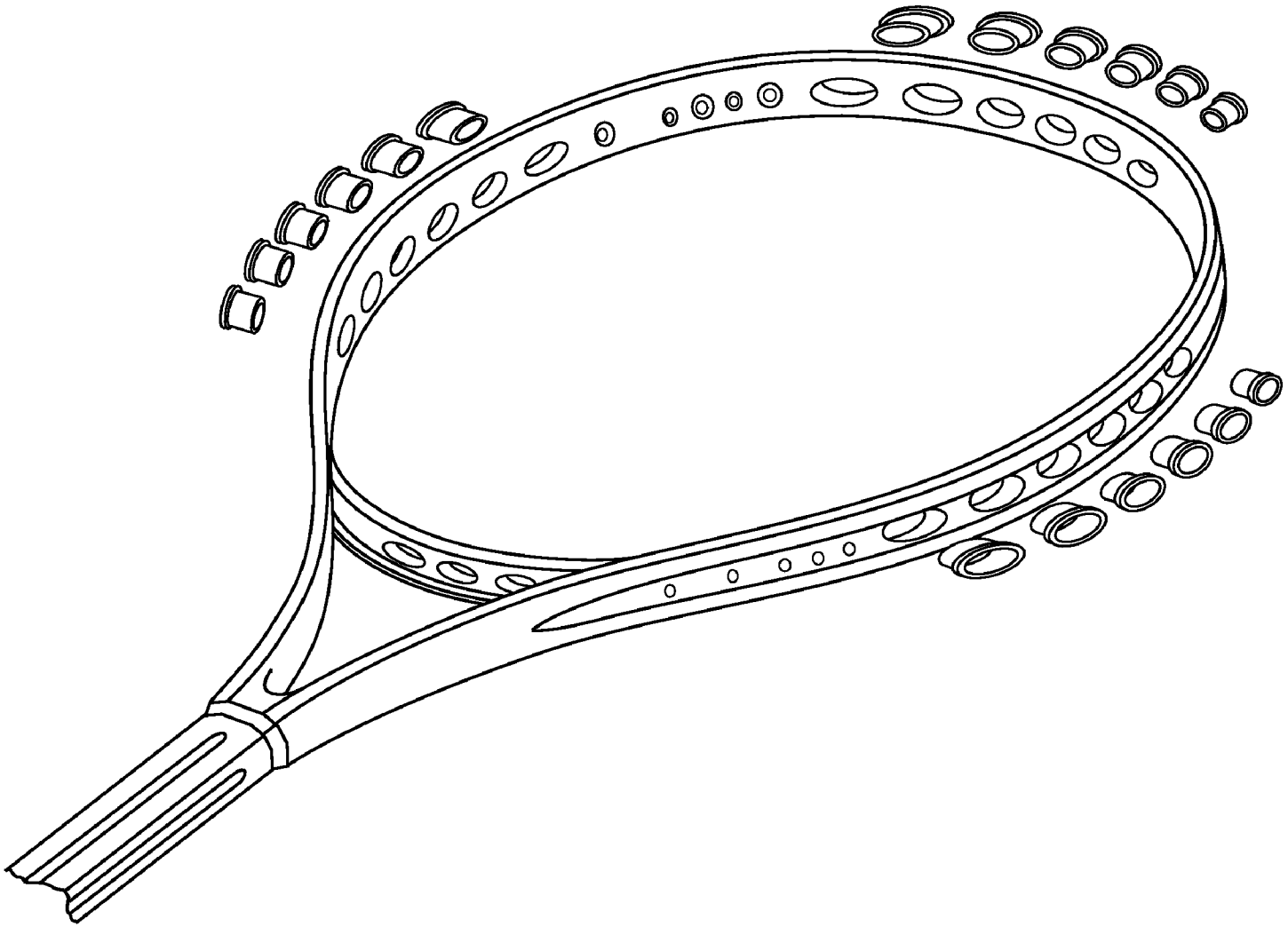
Figure 30:
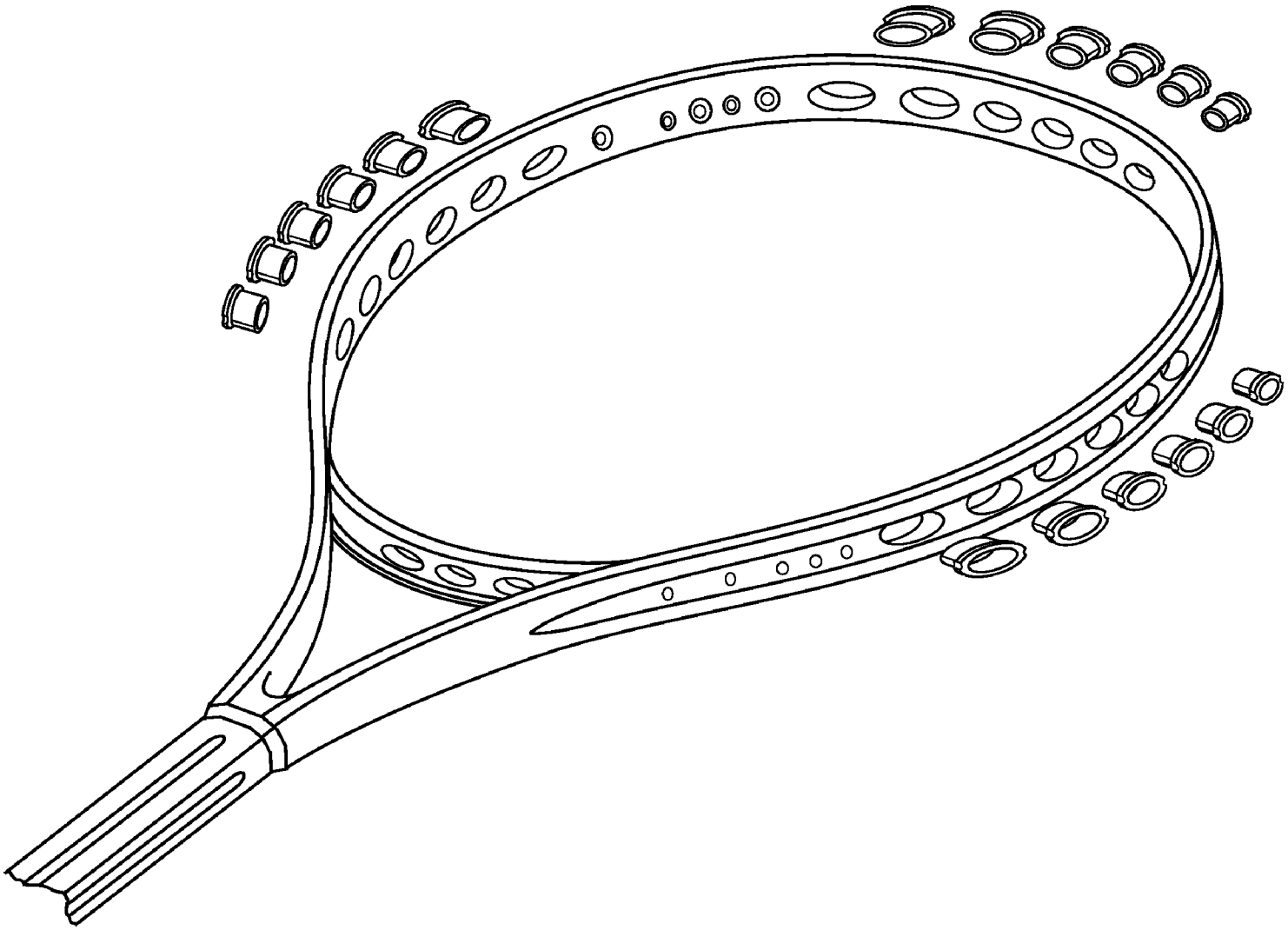

In most stringing patterns, the corners of the racquet include the ends of both main and cross strings. Such string ends may pass through the frame relatively close to one another. FIGS. 26*a*-26*c* show various shapes for enlarged string holes 140*a*-140*c* that may be used in the corners of the racquet. In FIGS. 26*a*-26*b*, the enlarged string holes are shaped so as to have multiple string seats, e.g., seats 141*a*-141*d*. The string seats are offset relative to the string bed plane, so as to be able to seat the ends of multiple string segments at multiple locations on the frame. As shown in FIG. 26*c*, if two string ends need to be located at the same location along the frame, e.g., if a main string end and a cross string end meet at the frame, overlapping pairs of enlarged string holes 140*c* can be offset from the center string bed plane, and thus two or more string seats 142*a*, 142*b* can be located at the same axial location on the frame, but spaced above one another. Thus, each such string would have its own seat, which will facilitate stringing.

The foregoing represent preferred embodiments of the invention. Variations and modifications will be apparent to persons skilled in the art, without departing from the inventive concepts disclosed herein. All such modifications and variations are intended to be within the scope of the invention, as defined in the following claims.

The invention claimed is:

1. A sports racquet having a frame including a head portion defining a stringing area and a handle portion coupled to said head portion, wherein said head portion includes a plurality of opposed string holes formed in said frame and having string bearing surfaces for anchoring the ends of a first set of string segments extending in a first direction and the ends of a second set of string segments extending in a second direction, wherein said string holes are positioned to provide a predetermined spacing between contiguous string segments in each set, characterized in that at least one of said string holes is a first enlarged string hole having at least two string bearing surfaces for securing the ends of a pair of contiguous string segments of said first set at said predetermined spacing, wherein said first set of string segments are cross string segments and said second set of string segments are main string segments, wherein said head portion includes a throat bridge having a plurality of contiguous enlarged string holes for anchoring a plurality of main string segments, said throat bridge having opposite ends, wherein each opposite end is split to allow outlying main strings to pass through said throat bridge, and wherein the split ends define a bearing surface for securing a main string in said throat bridge.

2. A sports racquet according to claim 1, wherein said frame has at least a second enlarged string hole opposed to said first enlarged string hole such that the opposite ends of a string segment can be received in both said first and second enlarged string holes.

3. A sports racquet according to claim 2, wherein said first and second enlarged string hole are staggered relative to one another.

4. A sports racquet according to claim 3, wherein said racquet includes at least one string having a plurality of string segments connected by connecting portions, wherein said at least one string extends through said string holes such that said string segments extend within said stringing area and form an interwoven string bed lying generally in a string bed plane, and said connecting portions extend along outer surfaces of said frame, wherein said at least one string is under tension, and wherein said outer surfaces act as bearing surfaces to counteract the tension of the strings.

5. A sports racquet according to claim 4, wherein said frame includes a plurality of contiguous enlarged string holes.

6. A sports racquet according to claim 5, wherein said enlarged string holes are oval in shape and whose major axis lies in said stringing plane, and wherein said holes have opposing ends along said major axis which form said string bearing surfaces.

7. A sports racquet according to claim 3, wherein said frame includes an inner surface facing said stringing area and an outer surface facing away from said stringing area, and wherein each enlarged string hole is defined by a pair of opposed interior walls of said frame extending between said inner and outer surfaces, thereby forming a truss-like internal structure.

8. A sports racquet according to claim 7, wherein said interior walls lie on opposite sides of the stringing plane.

9. A sports racquet according to claim 8, wherein said frame includes a first plurality of contiguous enlarged string holes and a second plurality of contiguous enlarged string holes which are opposed to said first plurality, and wherein said frame includes interior wall portions extending between each contiguous pair of enlarged string holes, and wherein said interior wall portions lie in the stringing plane and underlie the connecting portions of the strings.

10. A sports racquet according to claim 9, wherein said interior wall portions are coextensive with said interior walls.

11. A sports racquet according to claim 3, wherein said frame includes a plurality of contiguous enlarged string holes, and wherein said racquet includes a grommet strip having grommets extending through said enlarged string holes, and an outer strip overlying said grommet strip and against which the connecting portions of the strings bear.

12. A sports racquet according to claim 11, characterized in that each said grommet includes a pair of small, parallel holes for receiving a pair of string segments.

* * * * *